US010224677B2

(12) United States Patent
Han et al.

(10) Patent No.: US 10,224,677 B2
(45) Date of Patent: Mar. 5, 2019

(54) CONNECTOR DEVICE

(71) Applicant: Samsung Electronics Co., Ltd., Suwon-si, Gyeonggi-do (KR)

(72) Inventors: Jae-Ryong Han, Hwaseong-si (KR); Wan-Eui Jung, Goyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/788,213

(22) Filed: Oct. 19, 2017

(65) Prior Publication Data

US 2018/0115116 A1 Apr. 26, 2018

(30) Foreign Application Priority Data

Oct. 21, 2016 (KR) ..... 10-2016-0137741

(51) Int. Cl.

| | |
|---|---|
| ***H01R 13/6581*** | (2011.01) |
| ***H01R 12/71*** | (2011.01) |
| ***H01R 13/502*** | (2006.01) |
| ***H01R 43/20*** | (2006.01) |
| ***H01R 12/72*** | (2011.01) |
| ***H01R 13/6594*** | (2011.01) |
| *H01R 12/70* | (2011.01) |
| *H01R 24/60* | (2011.01) |
| *H01R 107/00* | (2006.01) |

(52) U.S. Cl.

CPC ..... *H01R 13/6581* (2013.01); *H01R 12/716* (2013.01); *H01R 12/725* (2013.01); *H01R 13/502* (2013.01); *H01R 13/6594* (2013.01); *H01R 43/205* (2013.01); *H01R 12/707* (2013.01); *H01R 24/60* (2013.01); *H01R 2107/00* (2013.01)

(58) Field of Classification Search

CPC ..... H01R 13/6585; H01R 2107/00; H01R 12/716; H01R 13/6471; H01R 24/60; H01R 12/724; H01R 13/04; H01R 13/405; H01R 13/658; H01R 13/6581; H01R 12/52; H01R 12/53; H01R 12/57; H01R 12/7005

See application file for complete search history.

(56) References Cited

U.S. PATENT DOCUMENTS 6,210,226 B1 * 4/2001 Zhu ..... H01R 24/64 439/607.4
9,379,494 B1 * 6/2016 Hu ..... H01R 13/6594
(Continued)

FOREIGN PATENT DOCUMENTS

KR 10-1510740 B1 4/2015
KR 10-2016-0075198 A 6/2016

*Primary Examiner* — Truc T Nguyen
(74) *Attorney, Agent, or Firm* — Jefferson IP Law, LLP

(57) ABSTRACT

A connector device included in an electronic device is provided. The connector device includes a connector main body including at least one hole and a slot, at least one housing coupled to the connector main body to shield the at least one hole and the slot, a shielding member included in a rear face of the at least one housing, at least one coupling portion included in each of opposite side faces of the at least one housing so as to couple the at least one housing, and at least one fixing portion included in one end of the at least one coupling portion and fixed to a board included in the electronic device. Various other embodiments are possible.

14 Claims, 15 Drawing Sheets

(56) References Cited

U.S. PATENT DOCUMENTS

| | | | | |
|---|---|---|---|---|
| 2010/0167584 | A1* | 7/2010 | He | H01R 13/506 439/607.01 |
| 2010/0248543 | A1* | 9/2010 | Yu | H01R 13/6658 439/607.01 |
| 2010/0279546 | A1* | 11/2010 | Yang | H01R 13/65802 439/607.31 |
| 2013/0164985 | A1 | 6/2013 | Cong et al. | |
| 2015/0200506 | A1* | 7/2015 | Guo | H01R 43/24 439/607.58 |
| 2016/0064864 | A1* | 3/2016 | Kao | H01R 13/6461 439/607.05 |
| 2016/0104957 | A1* | 4/2016 | Kim | H01R 13/5219 439/78 |
| 2016/0126677 | A1* | 5/2016 | Yu | H01R 13/6474 439/607.23 |
| 2016/0181722 | A1 | 6/2016 | Tsai et al. | |
| 2016/0329645 | A1* | 11/2016 | Tsai | H01R 13/6585 |
| 2016/0329663 | A1 | 11/2016 | Han et al. | |

* cited by examiner

CONNECTOR DEVICE

CROSS-REFERENCE TO RELATED APPLICATION(S)

This application claims the benefit under 35 U.S.C. § 119(a) of a Korean patent application filed on Oct. 21, 2016 in the Korean Intellectual Property Office and assigned Serial No. 10-2016-0137741, the entire disclosure of which is hereby incorporated by reference.

TECHNICAL FIELD

The present disclosure relates to a connector device used in an electronic device.

BACKGROUND

Recently, various electronic devices, such as a motion picture experts group (MPEG-1 or MPEG-2) audio layer-3 (MP3) player, a portable multimedia player (PMP), a tablet personal computer (PC), a Galaxy Tab, a smart phone, an iPad, and an electronic book terminal, have been provided to users, and users are capable of accessing various content while carrying the various electronic devices. Such electronic devices are configured such that consumers may use the electronic devices conveniently, and may have a luxurious design. In addition to design trends such as thickness reduction, various types of wireless mobile communication services using various frequency bands are supported. A connector device, such as a communication port, to which a plug connector is connected, may be mounted inside the portable electronic device, in order to ensure the compatibility of data or the like. A representative example of such connector devices may be a universal service bus (USB) connector.

The above information is presented as background information only to assist with an understanding of the present disclosure. No determination has been made, and no assertion is made, as to whether any of the above might be applicable as prior art with regard to the present disclosure.

SUMMARY

Connector devices of the related art are classified into a surface-mount type and an insertion-mount type. In the surface-mount type, a plurality of pins provided on a connector is soldered onto a printed circuit board, and in the insertion-mount type, a plurality of pins provided on the connector is inserted through the printed circuit board. The surface-mount type has advantages pertaining to cost and time compared to the insertion-mount type. Accordingly, various components (e.g., connectors) mounted on a printed circuit board are mainly configured in the surface-mount type.

However, when connector devices of the related art are mounted on the printed circuit board, the connector devices of the related art are exposed as they are, and as a result, the connector devices cannot realize shielding at all. Therefore, there is a disadvantage in that a data communication component, which is generated when data communication is performed, acts as noise affecting an antenna performance, thereby deteriorating the radiation performance of the antenna. For example, in a connector device of the related art, when an SUS plate is formed through a pressing method, an assembly-coupling portion is formed by cutting the SUS plate or by bending the SUS plate after cutting the SUS plate in order to allow the connector device to be assembled with a printed circuit board, and a hole or a slit is formed in the connector device by the assembly-coupling portion. Through this hole or slot, the data communication component is scattered so that noise is generated, which reduces the radiation performance of an antenna.

Aspects of the present disclosure are to address at least the above-mentioned problems and/or disadvantages and to provide at least the advantages described below. Accordingly, an aspect of the present disclosure is to provide a connector device in which a hole and a slot formed in a connector main body are shielded by at least one housing.

In accordance with an aspect of the present disclosure, a connector device is provided. The connector device includes a connector main body including at least one hole and a slot, at least one housing coupled to the connector main body to shield the at least one hole and the slot, a shielding member included in a rear face of the at least one housing, at least one coupling portion included in each of, and at least one fixing portion included in one end of the at least one coupling portion and fixed to a board included in the electronic device.

In accordance with another aspect of the present disclosure, a connector device is provided. The connector device includes a connector main body including at least one hole and a slot, a first housing coupled to a top face of the connector main body to enclose the top face of the connector main body, the first housing shielding the at least one hole and the slot, a second housing coupled to the bottom face of the connector main body to enclose a bottom face of the connector main body, the second housing shielding the at least one hole and the slot formed in the bottom face of the connector main body, first and second shielding members included in rear faces of the first and second housings and shielding the rear faces of the first and second housings, at least one coupling portion included in each of opposite side faces of the first and second housings to couple the first and second housings, and at least one fixing portion included in one end of the at least one coupling portion and fixed to a board included in the electronic device.

In accordance with another aspect of the present disclosure, a method of manufacturing a connector device is provided. The method includes manufacturing a connector main body by a pressing method such that the connector main body manufactured in this way includes at least one hole and a slot, coupling a first housing to a top face of the connector main body to enclose the top face of the connector main body such that the at least one hole and the slot are shielded by the first housing, coupling the second housing to a bottom face of the connector main body to enclose the bottom face of the connector main body so as to shield the at least one hole and the slot by the second housing, providing first and second shielding members on the rear faces of the first and second housings so as to shield the rear faces of the first and second housings, providing at least one coupling portion on each of opposite side faces of the first and second housings and coupling the first and second housings, and providing at least one fixing portion at one end of the at least one coupling portion, and fixing the connector device to a board included in the electronic device by the at least one fixing portion.

According to various embodiments of the present disclosure, by configuring at least one housing to be coupled to a connector main body so as to enclose and shield a hole and a slot formed in the connector main body, it is possible to prevent noise from being generated due to the emission of data communication components through the hole and the slot as well as to prevent the radiation performance of an antenna from deteriorating, thereby improving the function of an antenna.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
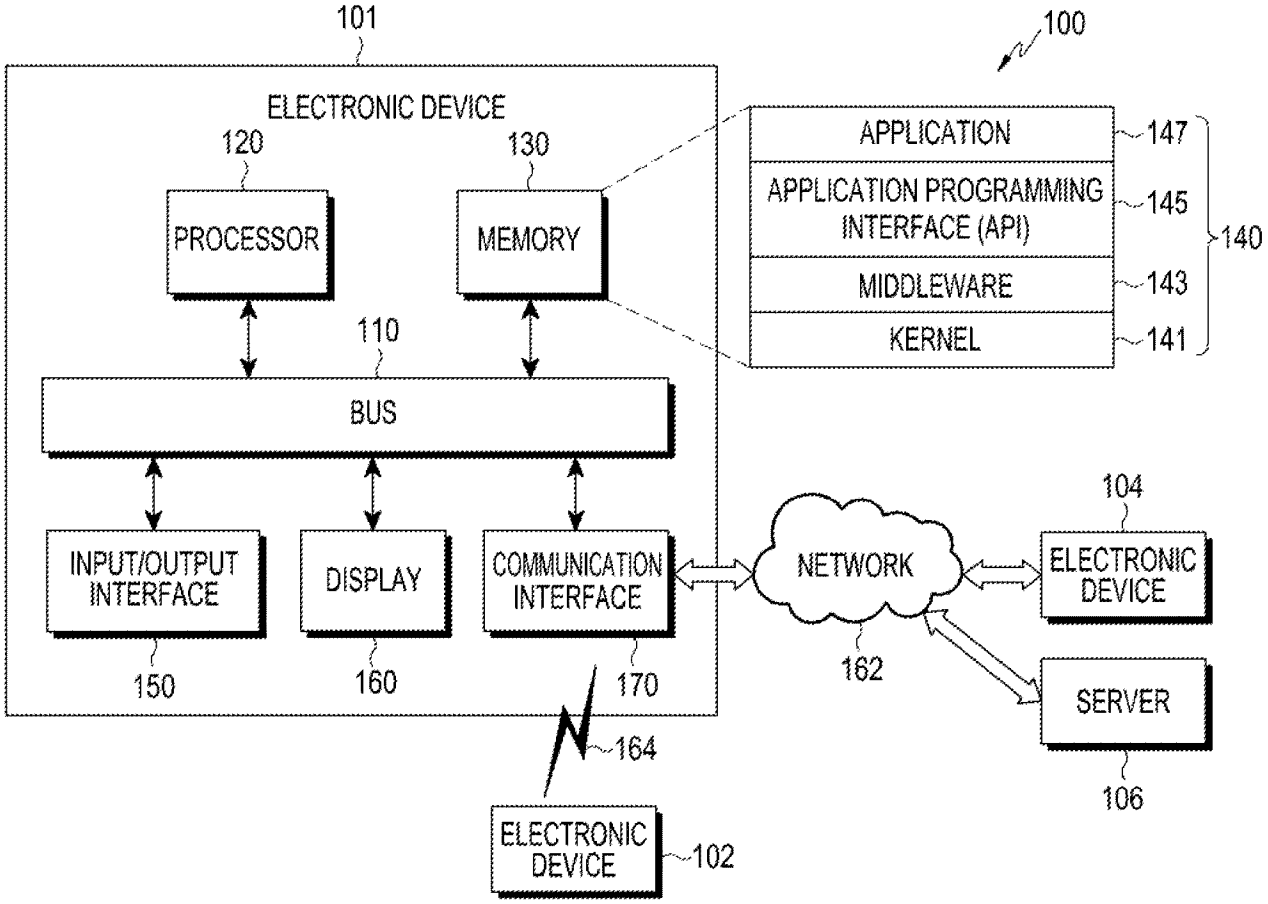
FIG. 1 is a block diagram illustrating a network environment that includes an electronic device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The expression "configured to" as used in various embodiments of the present disclosure may be interchangeably used with, for example, "suitable for," "having the capacity to," "designed to," "adapted to," "made to," or "capable of" in terms of hardware or software, according to circumstances. Alternatively, in some situations, the expression "device configured to" may mean that the device, together with other devices or components, "is able to." For example, the phrase "processor adapted (or configured) to perform A, B, and C" may mean a dedicated processor (e.g., embedded processor) only for performing the corresponding operations or a generic-purpose processor (e.g., central processing unit (CPU) or application processor (AP)) that can perform the corresponding operations by executing one or more software programs stored in a memory device.

An electronic device according to various embodiments of the present disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a motion picture experts group (MPEG-1 or MPEG-2) audio layer-3 (MP3) player, a mobile medical device, a camera, and a wearable device. According to various embodiments, the wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a body-mounted type (e.g., a skin pad, or tattoo), and a bio-implantable type (e.g., an implantable circuit). In some embodiments, the electronic device may include at least one of, for example, a television (TV), a digital versatile disc (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

In other embodiments, the electronic device may include at least one of various medical devices (e.g., various portable medical measuring devices (a blood glucose monitoring device, a heart rate monitoring device, a blood pressure measuring device, a body temperature measuring device, etc.), a magnetic resonance angiography (MRA), a magnetic resonance imaging (MRI), a computed tomography (CT) machine, and an ultrasonic machine), a navigation device, a global positioning system (GPS) receiver, an event data recorder (EDR), a flight data recorder (FDR), a Vehicle Infotainment Devices, an electronic devices for a ship (e.g., a navigation device for a ship, and a gyro-compass), avionics, security devices, an automotive head unit, a robot for home or industry, an automatic teller's machine (ATM) in banks, point of sales (POS) in a shop, or internet device of things (e.g., a light bulb, various sensors, electric or gas meter, a sprinkler device, a fire alarm, a thermostat, a streetlamp, a toaster, a sporting goods, a hot water tank, a heater, a boiler, etc.). According to some embodiments, an electronic device may include at least one of a part of furniture or a building/structure, an electronic board, an electronic signature receiving device, a projector, and various types of measuring instruments (e.g., a water meter, an electric meter, a gas meter, a radio wave meter, and the like). In various embodiments, the electronic device may be flexible, or may be a combination of one or more of the aforementioned various devices. The electronic device according to an embodiment of the present disclosure is not limited to the above described devices. As used herein, the term "user" may indicate a person who uses an electronic device or a device (e.g., an artificial intelligence electronic device) that uses an electronic device.

FIG. 1 is a block diagram illustrating a network environment that includes an electronic device according to various embodiments of the present disclosure.

Referring to FIG. 1, an electronic device 101 within the network environment 100, in various embodiments will be described. The electronic device 101 may include a bus 110, a processor 120, a memory 130, an input/output interface 150, a display 160, and a communication interface 170. In a certain embodiment, at least one of the above-mentioned components may be omitted from the electronic device 101 or other components may be additionally included in the electronic device 101. The bus 110 may include a circuit that interconnects the above-mentioned components 110 to 170 and transfers communication information (e.g., a control message or data) among the components 110 to 170. The processor 120 may include one or more of a CPU, an AP, and a communication processor (CP). The processor 120 may execute, for example, an arithmetic operation or data processing that is related to the control and/or communication of one or more other components of the electronic device 101.

The memory 130 may include a volatile memory and/or a non-volatile memory. The memory 130 may store, for example, commands or data that are related to one or more other components of the electronic device 101. According to an embodiment, the memory 130 may store software and/or a program 140. The program 140 may include, for example, a kernel 141, middleware 143, an application programming interface (API) 145, and/or an application 147. At least one of the kernel 141, the middleware 143, and the API 145 may be referred to as an operating system (OS). The kernel 141 may control or manage, for example, system resources (e.g., the bus 110, the processor 120, or the memory 130) that are used for executing operations or functions implemented in the other programs (e.g., the middleware 143, the API 145, or the application 147). In addition, the kernel 141 may provide an interface that allows the middleware 143, the API 145, or the application 147 to access individual components of the electronic device 101 so as to control or manage the system resources.

The middleware 143 may play an intermediary role such that, for example, the API 145 or the application 147 may communicate with the kernel 141 so as to exchange data. In addition, the middleware 143 may process one or more task requests which are received from the applications 147, according to the priority thereof. For example, the middleware 143 may assign the priority to be capable of using a system resource of the electronic device 101 (e.g., the bus 110, the processor 120, or the memory 130) to at least one of the applications 147, and may process the one or more task requests. The API 145 is, for example, an interface that allows the applications 147 to control functions provided from the kernel 141 or the middleware 143, and may include, for example, one or more interfaces or functions (e.g., commands) for file control, window control, image processing, or a character control. The input/output interface 150 may transmit commands or data, which are input from, for example, a user or another external device, to the other component(s) of the electronic device 101, or may output commands or data, which are received from the other component(s) of the electronic device 101, to the user or the other external device.

The display device 160 may include, for example, a liquid crystal display (LCD), a light emitting diode (LED) display, an organic LED (OLED) display, a microelectromechanical system (MEMS) display, or an electronic paper display. The display 160 may display various content (e.g., text, image, video, icon, or symbol) to, for example, the user. The display 160 may include a touch screen, and may receive a touch input, a gesture input, a proximity input, or a hovering input that is made using, for example, an electronic pen or a part of the user's body. The communication interface 170 may set, for example, communication between the electronic device 101 and an external device (e.g., a first external electronic device 102, a second external device 104, or a server 106). For example, the communication interface 170 may be connected with a network 162 through wired or wireless communication so as to communicate with the external device (e.g., the second external electronic device 104 or the server 106). As another example, the communication interface 170 may set communication between the wireless device 101 and the electronic device 102 using a wireless communication 164.

The wireless communication may include a cellular communication that uses at least one of, for example, long-term evolution (LTE), LTE-advanced (LTE-A), code division multiple access (CDMA), wideband CDMA (WCDMA), universal mobile telecommunication system (UMTS), wireless broadband (WiBro), and global system for mobile communication (GSM). According to an embodiment, the wireless communication may include at least one of, for example, Wi-Fi, Bluetooth (BT), BT low energy (BLE), ZigBee, near field communication (NFC), magnetic secure transmission, radio frequency (RF), and body area network (BAN). According to an embodiment, the wireless communication may include global navigation satellite system (GNSS). The GNSS may include, for example, at least one of GPS, global navigation satellite system (GLONASS), BeiDou Navigation Satellite System (hereinafter, "BeiDou"), Galileo, and the European global satellite-based navigation system, according to, for example, a use area or bandwidth. In the present disclosure, "GPS" may be interchangeably used with "GNSS" below. The wired communication may use at least one of, for example, universal serial bus (USB), high-definition multimedia interface (HDMI), recommended standard 232 (RS-232), power line communication, and plain old telephone service (POTS). The network 162 may include a telecommunication network (e.g., at least one of a computer network (e.g., local area network (LAN) or wide area network (WAN)), the internet, and a telephone network).

Each of the first and second external electronic devices 102 and 104 may be of a type the same as or different from that of the electronic device 101. According to various embodiments, all or some of the operations to be executed by the electronic device 101 may be executed in another electronic device or a plurality of other electronic devices (e.g., the electronic devices 102 and 104 or the server 106). According to an embodiment, in the case where the electronic device 101 should perform a certain function or service automatically or in response to a request, the electronic device 101 may request some functions or services that are associated therewith from other electronic devices (e.g., the electronic devices 102 and 104 or the server 106), instead of, or in addition to, executing the functions or service by itself The other electronic devices (e.g., the electronic devices 102 and 104 or the server 106) may execute the requested functions or additional functions, and may deliver the results to the electronic device 101. The electronic device 101 may provide the requested functions or services by processing the received results as they are or additionally. For this purpose, for example, a cloud computing technique, a distributed computing technique, or a client-server computing technique may be used.

Figure 2:
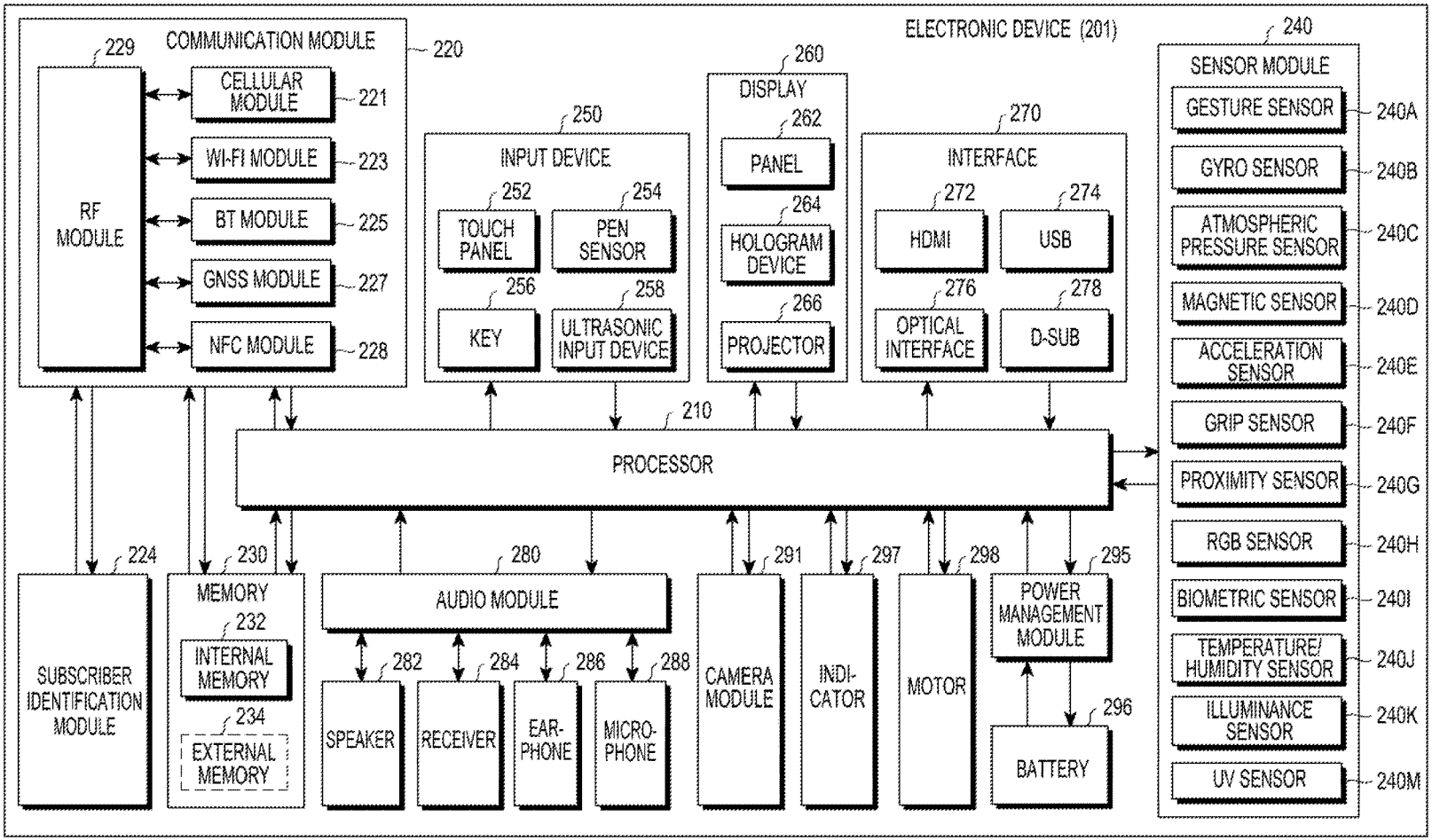
FIG. 2 is a block diagram of an electronic device according to various embodiments of the present disclosure.

FIG. 2 is a block diagram of an electronic device according to various embodiments of the present disclosure.

Referring to FIG. 2, an electronic device 201 may include, for example, all or a portion of the electronic device 101 illustrated in FIG. 1. The electronic device 201 may include at least one processor (e.g., an AP) 210, a communication module 220, a subscriber identification module 224, a memory 230, a sensor module 240, an input device 250, a display 260, an interface 270, an audio module 280, a camera module 291, a power management module 295, a battery 296, an indicator 297, and a motor 298. The processor 210 may drive, for example, an operating system or an application program so as to control a plurality of hardware or software components connected thereto, and may also perform various data processing and arithmetic operations. The processor 210 may be implemented by, for example, a system-on-chip (SoC). According to an embodiment, the processor 210 may further include a graphic processing unit (GPU) and/or an image signal processor. The processor 210 may include at least some components (e.g., a cellular module 221) among the components illustrated in FIG. 2. The processor 210 may load a command or data received from at least one of the other components (e.g., a non-volatile memory) in a volatile memory to process the command and data, and may store the resultant data in a non-volatile memory.

The communication module 220 may have a configuration that is the same as or similar to that of the communication interface 170. The communication module 220 may include, for example, the cellular module 221, a Wi-Fi module 223, a Bluetooth module 225, a GNSS module 227, an NFC module 228, and a RF module 229. The cellular module 221 may provide, for example, a voice call, a video call, a message service, or an Internet service through a communication network. According to an embodiment, the cellular module 221 may perform discrimination and authentication of the electronic device 201 within the communication network using the subscriber identification module (e.g., a subscriber identity module (SIM) card) 224. According to an embodiment, the cellular module 221 may perform at least some of the multimedia control functions that may be provided by the processor 210. According to an embodiment, the cellular module 221 may include a CP. According to a certain embodiment, at least some (e.g., two or more) of the cellular module 221, the Wi-Fi module 223, the Bluetooth module 225, the GNSS module 227, and the NFC module 228 may be incorporated in a single integrated chip (IC) or an IC package. The RF module 229 may transmit/receive a communication signal (e.g., an RF signal). The RF module 229 may include, for example, a transceiver, a power amp module (PAM), a frequency filter, a low noise amplifier (LNA), or an antenna. According to another embodiment, at least one of the cellular module 221, the Wi-Fi module 223, the Bluetooth module 225, the GNSS module 227, and the NFC module 228 may transmit/receive RF signals through a separate RF module. The subscriber identification module 224 may include, for example, a card that includes a subscriber identification module and/or an embedded SIM, and may also include intrinsic identification information (e.g., integrated circuit card identifier (ICCID)) or subscriber information (e.g., international mobile subscriber identity (IMSI)).

The memory 230 (e.g., the memory 130) may include, for example, an internal memory 232 or an external memory 234. The internal memory 232 may include at least one of, for example, a volatile memory (e.g., a dynamic random access memory (DRAM), an static RAM (SRAM), or an synchronous DRAM (SDRAM)), a non-volatile memory (e.g., an one-time programmable read only memory (OTPROM), a programmable ROM (PROM), an erasable programmable ROM (EPROM), an electrically erasable programmable ROM (EEPROM,) a mask ROM, a flash ROM, a flash memory, a hard drive, and a solid-state drive (SSD). The external memory 234 may further include a flash drive (e.g., a compact flash (CF), a secure digital (SD), a micro-SD, a mini-SD, an extreme Digital (xD), a multi-media card (MMC), or a memory stick). The external memory 234 may be functionally or physically connected to the electronic device 201 through various interfaces.

For example, the sensor module 240 may measure a physical quantity or may sense the operating status of the electronic device 201, and may then convert the measured or sensed information into electric signals. The sensor module 240 may include at least one of, for example, a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (e.g., red, green, blue (RGB) sensor), a biometric sensor 240I, a temperature/humidity sensor 240J, an illuminance sensor 240K, and an ultra-violet (UV) sensor 240M. Additionally, or alternatively, the sensor module 240 may include, for example, an E-nose sensor, an electromyography (EMG) sensor, an electroencephalogram (EEG) sensor, an electrocardiogram (ECG) sensor, an infra-red (IR) sensor, an iris sensor, and/or a fingerprint sensor. The sensor module 240 may further include a control circuit for controlling one or more sensors incorporated therein. In a certain embodiment, the electronic device 201 may further include a processor configured to control the sensor module 240 as a part of the processor 210 or separate from the processor 210 so as to control the sensor module 240 while the processor 21 is in a sleeping state.

The input device 250 may include, for example, a touch panel 252, a (digital) pen sensor 254, a key 256, or an ultrasonic input device 258. As the touch panel 252, at least one of, for example, a capacitive type touch panel, a resistive type touch panel, an infrared type touch panel, and an ultrasonic type panel may be used. Also, the touch panel 252 may further include a control circuit. The touch panel 252 may further include a tactile layer so as to provide a tactile reaction to the user. The (digital) pen sensor 254 may be, for example, a portion of the touch panel, or may include a separate recognition sheet. The key 256 may include, for example, a physical button, an optical key, or a keypad. The ultrasonic input device 258 may sense, through a microphone (e.g., a microphone 288), ultrasonic waves generated by an input tool so as to confirm data corresponding to the sensed ultrasonic waves.

The display 260 (e.g., the display 160) may include a panel 262, a hologram device 264, a projector 266, and/or a control circuit for controlling these components. The panel 262 may be implemented to be, for example, flexible, transparent, or wearable. The panel 262 may be constituted with the touch panel 252 and one or more modules. According to an embodiment, the panel 262 may include a pressure sensor (or a force sensor) that is capable of measuring the intensity of pressure of a user's touch. The pressure sensor may be integrally implemented with the touch panel 252, or implemented by one or more sensors separately from the touch panel 252. The hologram device 264 may show a stereoscopic image in the air using interference of light. The projector 266 may project light onto a screen so as to display an image. The screen may be located, for example, inside or outside the electronic device 201. The interface 270 may include, for example, an HDMI 272, a USB 274, an optical interface 276, or a d-subminiature (D-sub) 278. For example, the interface 270 may be included in the communication interface 170 illustrated in FIG. 1. Additionally, or alternatively, the interface 270 may include, for example, a mobile high-definition link (MHL) interface, an SD card/MMC interface, or an infrared data association (IrDA) standard interface.

The audio module 280 may bi-directionally convert, for example, sound and electric signals. At least some of the components of the audio module 280 may be included in, for example, the input/output interface 150 illustrated in FIG. 1. The audio module 280 may process sound information input or output through, for example, a speaker 282, a receiver 284, an earphone 286, or a microphone 288. The camera module 291 is a device that is capable of capturing an image, for example, a still image or a video image, and according to an embodiment, the camera module 291 may include at least one image sensor (e.g., a front sensor or a rear sensor), a lens, an image signal processor (ISP), or a flash (e.g., LED or xenon lamp). The power management module 295 may manage, for example, the electric power of the electronic device 201. According to an embodiment, the power management module 295 may include a power management integrated circuit (PMIC), a charger integrated circuit (IC), or a battery or fuel gauge. The PMIC may be configured as a wired and/or wireless charging type. The wireless charging type may include, for example, a magnetic resonance type, a magnetic induction type, or an electromagnetic wave type, and may further include an additional circuit for wireless charging (e.g., a coil loop, a resonance circuit, or a rectifier). The battery gauge may measure the remaining charge of the battery 296, and a voltage, a current, or a temperature during the charge. The battery 296 may include, for example, a rechargeable battery and/or a solar battery.

The indicator 297 may indicate a specific status (e.g., a booting status, a message status, or a charged status) of the electronic device 201 or of a part thereof (e.g., AP 210). The motor 298 may convert an electric signal into a mechanical vibration, and may generate, for example, a vibration or a haptic effect. The electronic device 201 may include, for example, a mobile TV support device (e.g., a GPU) that is capable of processing media data according to a standard of, for example, digital multimedia broadcasting (DMB), digital video broadcasting (DVB), or MediaFlo™. Each of the components described herein may be constituted with one or more components, and the names of the corresponding components may vary depending on a type of an electronic device. In various embodiments, an electronic device (e.g., the electronic device 201) may not include some of the components, or may include an additional component. Alternatively, some of the components may be combined with each other to be configured as one object, and to perform the functions, which are the same as those of the corresponding components prior to the combination.

Figure 3:
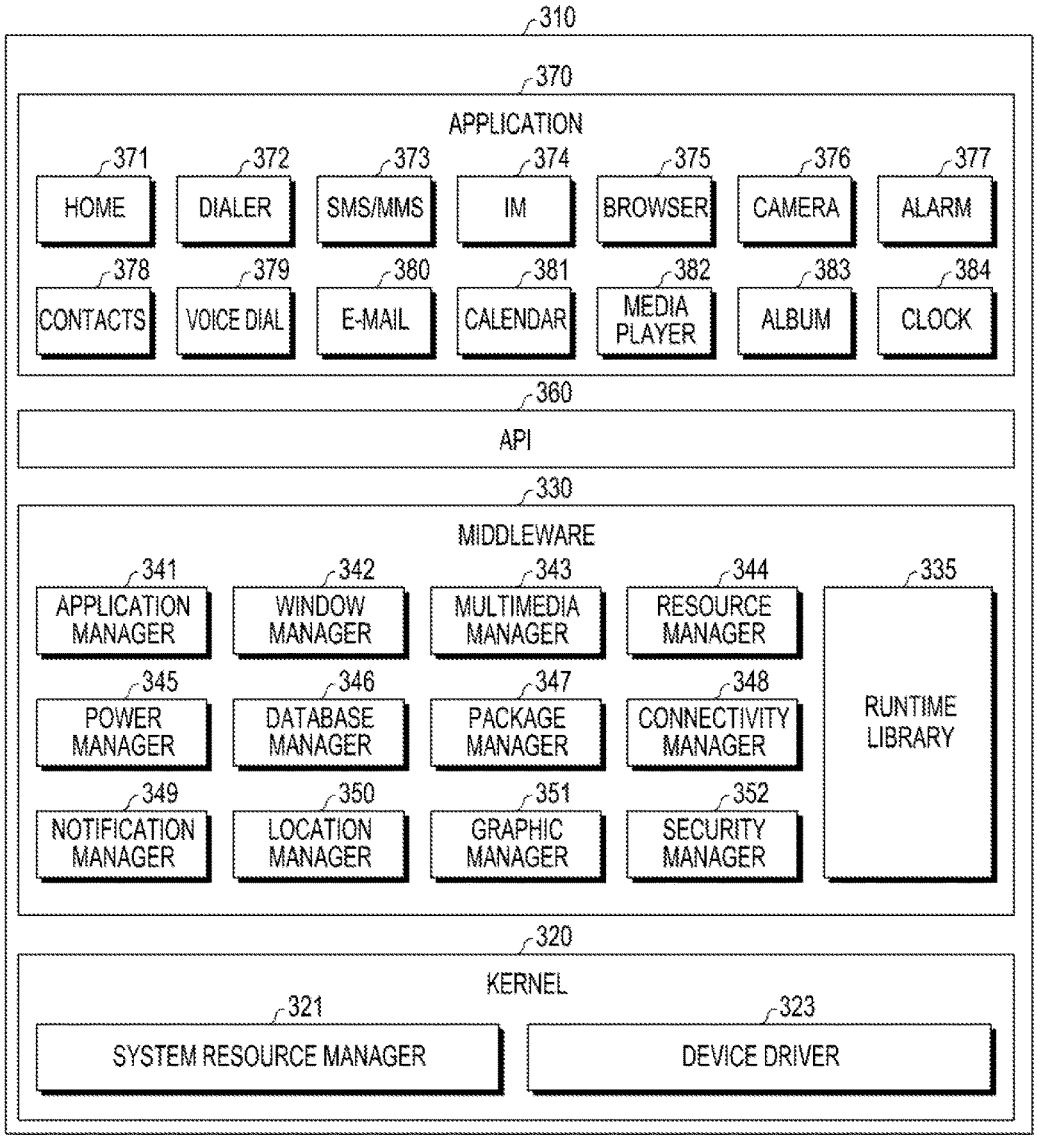
FIG. 3 is a block diagram illustrating a program module according to various embodiments of the present disclosure.

FIG. 3 is a block diagram illustrating a program module according to various embodiments of the present disclosure.

Referring to FIG. 3, a program module 310 (e.g., the program 140) may include an operating system (OS) that controls resources associated with an electronic device (e.g., the electronic device 101) and/or various applications (e.g., the application 147) that are driven on the operating system. The operating system may include, for example, Android™, iOS™, Windows™, Symbian™, Tizen™, or Bada™. Referring to FIG. 3, the program module 310 may include a kernel 320 (e.g., the kernel 141), a middleware 330 (e.g., the middleware 143), an API 360 (e.g., the API 145), and/or an application 370 (e.g., the application 147). At least a part of the program module 310 may be preloaded on the electronic device, or may be downloaded from an external electronic device (e.g., the device 102 or 104, or the server 106).

The kernel 320 may include, for example, a system resource manager 321 and/or a device driver 323. The system resource manager 321 may perform, for example, control, allocation, or recovery of a system resource. According to an embodiment, the system resource manager 321 may include, for example, a process management unit, a memory management unit, or a file system management unit. The device driver 323 may include, for example, a display driver, a camera driver, a Bluetooth driver, a common memory driver, a USB driver, a keypad driver, a Wi-Fi driver, an audio driver, or an inter-process communication (IPC) driver. The middleware 330 may provide, for example, a function that is commonly required by the applications 370, or may provide various functions to the applications 370 through the API 360 such that the applications 370 can efficiently use the limited system resources within the electronic device. According to an embodiment, the middleware 330 may include at least one of, for example, a runtime library 335, an application manager 341, a window manager 342, a multimedia manager 343, a resource manager 344, a power manager 345, a database manager 346, a package manager 347, a connectivity manager 348, a notification manager 349, a location manger 350, a graphic manager 351, and a security manager 352.

The runtime library 335 may include, for example, a library module that is used by a compiler in order to add a new function through a program language while the applications 370 are executed. The runtime library 335 may perform, for example, input/output management, memory management, or processing of an arithmetic function. The application manager 341 may manage, for example, a life cycle of the applications 370. The window manager 342 may manage a GUI resource that is used in a screen. The multimedia manager 343 may recognize a format required for reproducing various media files, and may perform encoding or decoding of the media files by using a codec that is suitable for the corresponding format. The application manager 344 may manage the source code of the applications 370 or a memory space. The power manager 345 may manager, for example, a battery capacity or power, and may provide power information required for operating the electronic device. According to an embodiment, the power manager 345 may be interlocked with a basic input/output system (BIOS). The database manager 346 may generate, retrieve, or change, for example, a database to be used by the applications 370. The package manager 347 may manage the installation or update of an application that is distributed in the form of a package file.

The connectivity manager 348 may manage, for example, a wireless connection. The notification manager 349 may provide events of, for example, an arrival massage, a promise, or proximity notification to the user. The location manager 350 may manage, for example, position information of the electronic device. The graphic manager 351 may manage a graphic effect to be provided to the user or a user interface associated therewith. The security manager 352 may provide, for example, system security or user authentication. According to an embodiment, the middleware 330 may include a telephony manager that manages a voice or video call function of the electronic device or a middleware module that may combine the functions of the above-described components. According to an embodiment, the middleware 330 may provide a module that is specialized for each kind of operation system. In addition, the middleware 330 may dynamically delete some of the existing components or add new components. The API 360 is, for example, a collection of API programming functions, and may be provided in different configurations depending on operation systems. For example, Android or iOS may provide one API set for each platform, and Tizen may provide two or more API sets for each platform.

The applications 370 may include one or more applications for providing, for example, a home 371, a dialer 372, an short message service (SMS)/multimedia messaging service (MMS) 373, an instant message (IM) 374, a browser 375, a camera 376, an alarm 377, contacts 378, a voice dial 379, an e-mail 380, a calendar 381, a media player 382, an album 383, and a clock 384, health care information (e.g., measurement of a quantity of motion, or blood sugar), or environmental information (e.g., atmospheric pressure, humidity, or temperature information). According to an embodiment, the applications 370 may include an information exchange application that may support information exchange between the electronic device and an external electronic device. The information exchange application may include, for example, a notification relay application to transmit specific information to the external electronic devices or a device management application to manage the external electronic devices. For example, the notification relay application may relay notification information generated by another application of the electronic device, or may receive notification from an external electronic device and may provide the notification information to the user. The device management application may, for example, install, delete, or update a function of an external electronic device that communicates with the electronic device (e.g., turn-on/turn-off of the external electronic device itself (or some components thereof) or adjustment of brightness (or resolution) of a display), or an application operated in the external electronic device. According to an embodiment, the applications 370 may include an application designated according to an attribute of an external electronic device (e.g., a healthcare application of a mobile medical device). According to an embodiment, the applications 370 may include an application received from an external electronic device. At least a part of the program module 310 may be implemented (e.g., executed) by software, firmware, hardware (e.g., the processor 210), or a combination of at least two of them, and may include a module, a program, a routine, a command set, or a process for performing one or more functions.

The term "module" as used herein may include a unit consisting of hardware, software, or firmware, and may, for example, be used interchangeably with the term "logic," "logical block," "component," "circuit," or the like. The "module" may be an integrated component, or a minimum unit for performing one or more functions or a part thereof The "module" may be mechanically or electronically implemented and may include, for example, an application-specific integrated circuit (ASIC) chip, a field-programmable gate arrays (FPGA), or a programmable-logic device, which has been known or are to be developed in the future, for performing certain operations. At least some of devices (e.g., modules or functions thereof) or methods (e.g., operations) according to various embodiments may be implemented by an instruction which is stored a computer-readable storage medium (e.g., the memory 130) in the form of a program module. The instruction, when executed by a processor (e.g., the processor 120), may cause the one or more processors to execute the function corresponding to the instruction. The computer-readable storage medium may include a hard disk, a floppy disk, a magnetic medium (e.g., a magnetic tape), an Optical Media (e.g., compact disc-ROM (CD-ROM), DVD), a magneto-optical media (e.g., a floptical disk), an inner memory, etc. The instruction may include a code which is made by a compiler or a code which may be executed by an interpreter. The programming module according to the present disclosure may include one or more of the aforementioned components or may further include other additional components, or some of the aforementioned components may be omitted. Operations performed by a module, a programming module, or other elements according to various embodiments may be executed sequentially, in parallel, repeatedly, or in a heuristic manner. At least some operations may be executed according to another sequence, may be omitted, or may further include other operations.

The electronic device to be described below may be formed of any one of the above-mentioned wearable device, a notebook computer, a netbook computer, a smart phone, a tablet PC, a Galaxy Tab, an iPad, and a wireless charging device.

According to various embodiments, the display of the electronic device may be implemented with a minimized bezel region, or may be flexible, convex, or concave.

For example, the peripheral portion of the display may be bent so that the screen area may be enlarged to a side portion. The screen region of the display, which is bent and enlarged to a side portion, may be used, or a separate screen may be used on the side portion. For example, the display may include a first screen region, and second screen regions included in the opposite sides of the first region.

Figure 4:
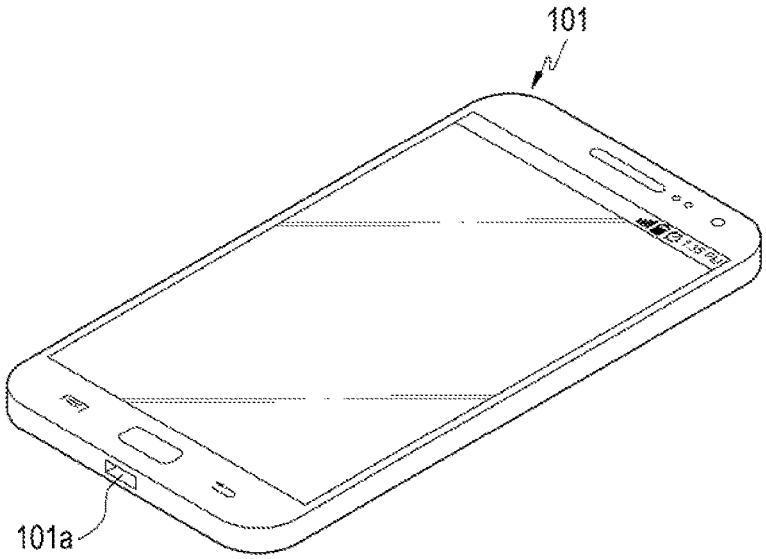
FIG. 4 is a perspective view illustrating a front face of an electronic device that includes a connector device according to various embodiments of the present disclosure.

FIG. 4 is a perspective view illustrating a front face of an electronic device that includes a connector device according to various embodiments of the present disclosure.

Referring to FIG. 4, the electronic device 101 may include an insertion hole 101*a* that is formed in a side face of the housing of the electronic device 101 and a connector device 1000 (see FIG. 5) may be embedded in the insertion hole 101*a*. For example, the connector device 1000 may be embedded in the insertion hole 101*a*, and in this state, when an external plug connector (not illustrated) is introduced through the insertion hole 101*a*, the plug connector can be electrically connected to the connector device 1000.

Figure 5:
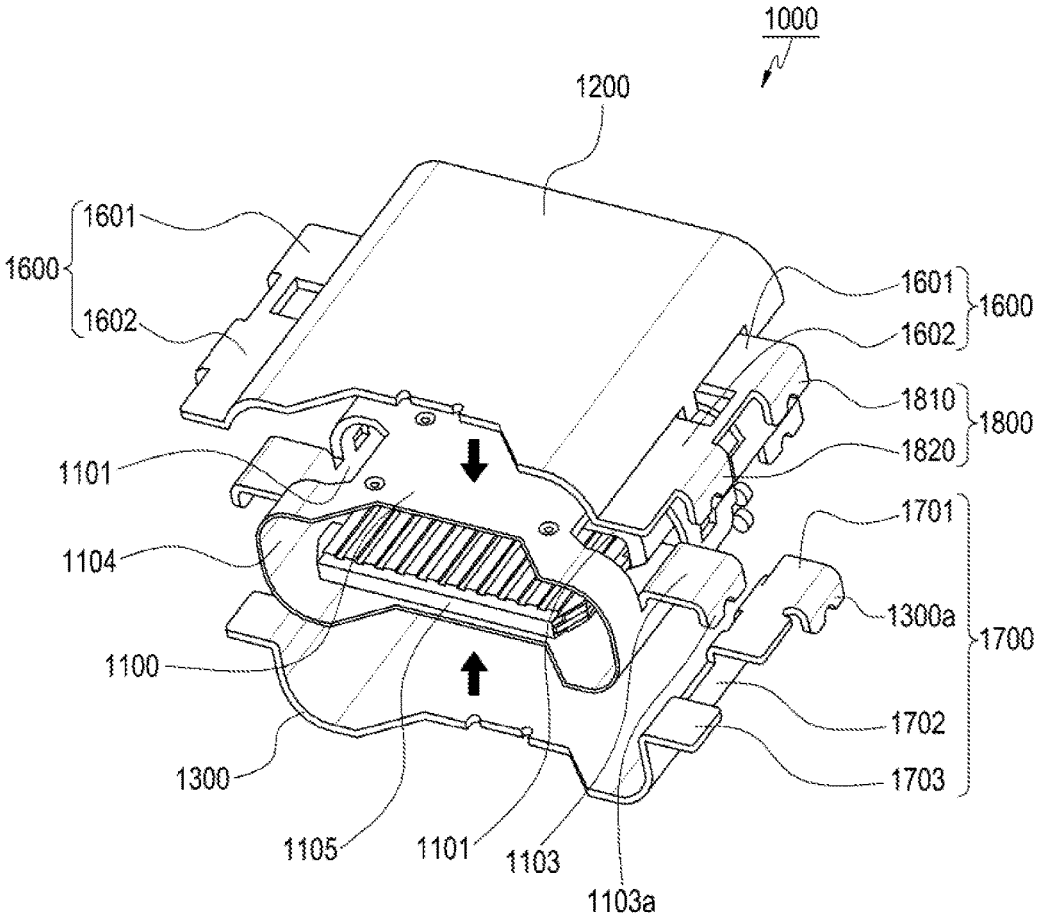
FIG. 5 is an exploded perspective view illustrating a configuration of a connector device according to various embodiments of the present disclosure, which is viewed from a front side.

FIG. 5 is an exploded perspective view illustrating a configuration of a connector device according to various embodiments of the present disclosure, which is viewed from the front side.

Figure 6:
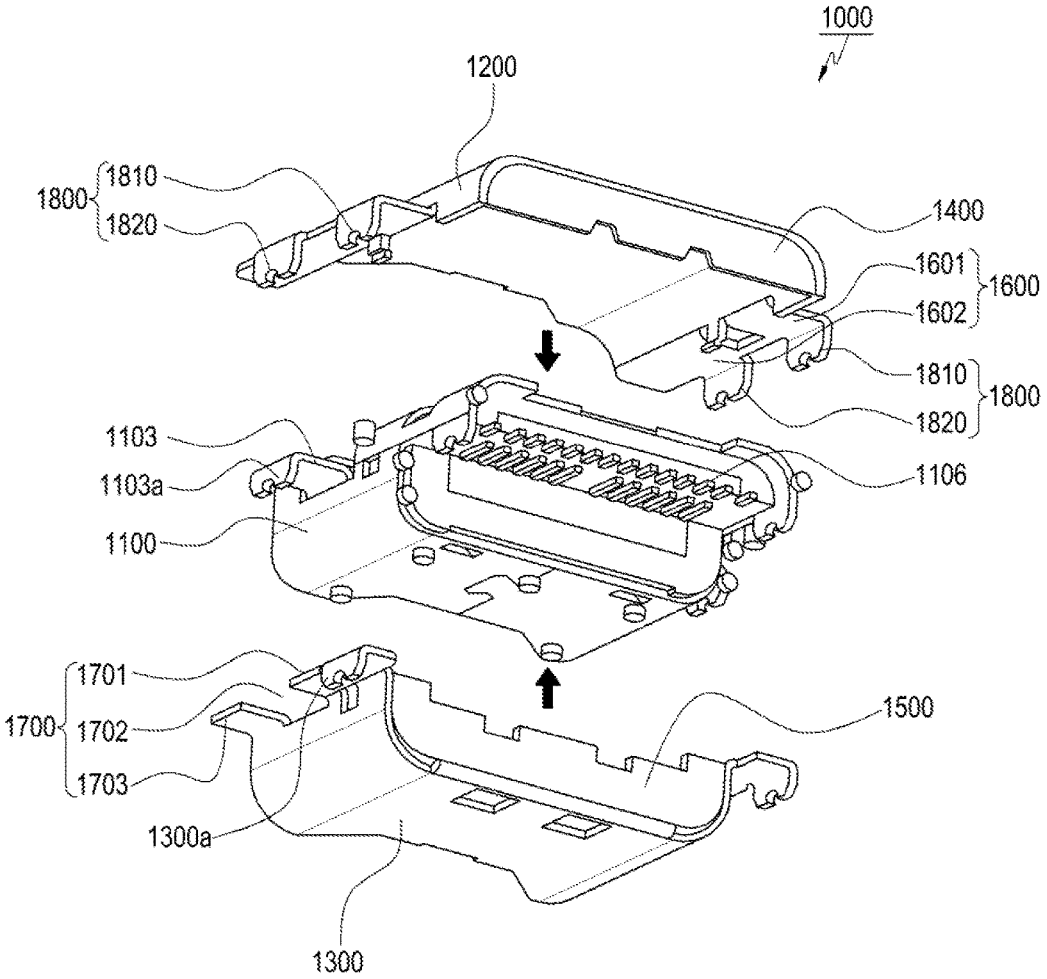
FIG. 6 is an exploded perspective view illustrating a configuration of a connector device according to various embodiments of the present disclosure, which is viewed from a rear side.

FIG. 6 is an exploded perspective view illustrating a configuration of a connector device according to various embodiments of the present disclosure, which is viewed from the rear side.

Referring to FIGS. 5 and 6, the connector device 1000 used in an electronic device 101 (e.g., see FIG. 4) includes, for example, a connector main body 1100, first and second housings 1200 and 1300, first and second shielding members 1400 and 1500, one or more coupling portions, and one or more fixing portions 1800.

The front face of the connector main body 1100 may include an opening 1104 such that a plug connector (not illustrated) is capable of being inserted into and coupled to the opening. The opening 1104 may include therein a terminal 1105 electrically connected to the plug connector (not illustrated).

The connector main body 1100 may be manufactured through a pressing method. At this time, one or more holes 1101 and a slot 1102 may be formed in the connector main body 1100.

The first housing 1200 may be provided on the top face of the main body 1100 to be coupled while enclosing the one or more holes 1101 and the slot 1102, so that the first housing 1200 blocks noise emitted through the one or more holes 1101 and the slot 1102.

The second housing 1300 may be provided on the bottom face of the main body 1100 to be coupled to while enclosing the one or more holes 1101 and the slot 1102, so that the second housing 1300 blocks noise emitted through the one or more holes 1101 and the slot 1102.

The first shielding member 1400 is provided on the rear face of the first housing 1200 in a spread state when the first housing 1200 is manufactured through the pressing method, and the first shielding member 1400 in the spread state is bent such that the first shielding member may shield the rear face of the first housing 1200.

The first shielding member 1400 is coupled to a pad on a board 101*b* included in the electronic device 101, so that a gap formed between the first shielding member 1400 and the board 101*b* can be eliminated. Through this, the noise generated from terminals 1106 can be blocked. For example, the removal of the gap may be achieved by at least one solder C1 (see FIG. 12) or by a weld.

The second shielding member 1500 is provided on the rear face of the second housing 1300 in a spread state when the second housing 1300 is manufactured through the pressing method, and the second shielding member 1500 in the spread state is bent such that the second shielding member may shield the rear face of the second housing 1300.

The first and second shielding members 1400 and 1500 are made to face the rear faces of the first and second housings 1200 and 1300, respectively. In this state, the first and second shielding members 1400 and 1500 may be respectively fixed to the rear faces of the first and second housings 1200 and 1300 by a weld B1. For example, the size of a gap, which is generated on the rear faces of the first and second housings 1200 and 1300 due to the bending of the first and second shielding members 1400 and 1500, may be reduced by a weld B1. Therefore, the first and second shielding members 1400 and 1500 can improve the shielding of the rear faces of the first and second housings 1200 and 1300.

The one or more coupling portions 1600 and 1700 may be provided to protrude from the opposite side faces of the first and second housings 1200 and 1300 such that the first and second housings 1200 and 1300 can be coupled in the state in which the first and second housings 1200 and 1300 cover the connector main body 1100.

The one or more fixing portions 1800 may be included at ends of the one or more coupling portions 1600 and 1700 to be fixed to the board 101*b* included in the electronic device 101 (illustrated in FIG. 4).

According to an embodiment, by coupling the first and second housings 1200 and 1300 and the first and second shielding members 1400 and 1500 to the connector main body 1100 so as to shield the upper, lower, and rear faces of the connector main body 1100 by the first and second housings 1200 and 1300 and the first and second shielding members 1400 and 1500, it is possible to block the noise emitted from the one or more holes 1101 and the slot 1102 in the connector main body 1100, thereby improving the antenna radiation function of the electronic device 100 (see FIG. 4) as well as further improving the function of an antenna (not illustrated).

The one or more coupling portions 1600 and 1700 may be coupled to each other by welding in order to enable the first and second housings 1200 and 1300 to be coupled thereto. In an embodiment, it is described that the one or more coupling portions 1600 and 1700 are coupled to each other by welding by way of example, but the present disclosure is not limited thereto. That is, various methods may be applied (e.g., using silicon, an adhesive member, or the like), so long as the first and second housings 1200 and 1300 can be coupled to the one or more coupling portions 1600 and 1700.

The one or more coupling portions 1600, which are included in the first housing 1200 according to an embodiment, will be described in more detail with reference to FIGS. 5 and 6.

The one or more coupling portions 1600 may include one or more first housing-side first coupling portions 1601 included in the first housing 1200 and configured to be coupled with second housing-side first coupling portions included in the second housing 1300, and one or more first housing-side second coupling portions 1602 provided adjacent to the one or more first housing-side first coupling portions 1601 and configured to be coupled with main body-side coupling portions 1103 included in the opposite side faces of the connector main body 1100.

The one or more coupling portions 1700, which are included in the second housing 1300 according to an embodiment, will be described in more detail below.

The one or more coupling portions 1700 may include one or more second housing-side first coupling portions 1701 included in the second housing 1300 and configured to be coupled with the one or more first housing-side first coupling portions 1600 included in the first housing 1200, and one or more second housing-side second coupling portions 1702 provided adjacent to the one or more second housing-side first coupling portions 1701 and configured to be coupled with main body-side coupling portions 1103 included in the opposite side faces of the connector main body 1100. One or more second housing-side third coupling portions 1703 may also be included adjacent to the one or more second housing-side second coupling portions 1702 and configured to be coupled with at least a portion of the first housing-side second coupling portions 1602 included in the first housing 1200.

Figure 7:
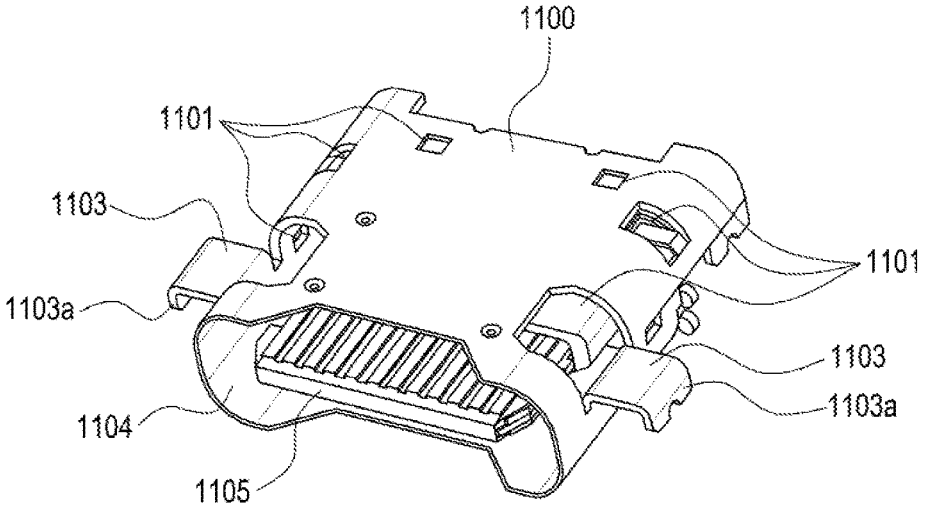
FIG. 7 is a perspective view illustrating a connector main body, among components of a connector device according to various embodiments of the present disclosure.

FIG. 7 is a perspective view illustrating a connector main body, among components of a connector device according to various embodiments of the present disclosure.

Referring to FIG. 7, when the connector main body 1100 is manufactured by a pressing method, the opposite side faces of the connector main body 1100 are cut so as to form the main body-side coupling portions 1103 on the connector main body 1100, and the opposite side faces cut as described above are bent so as to protrude from the connector main body 1100. Ends of the main body coupling portions 1103 protruding as described above may include main body-side fixing portions 1103*a*, which are respectively coupled to the second fixing portions 1820 formed on the first housing-side second coupling portions 1602.

Figure 8:
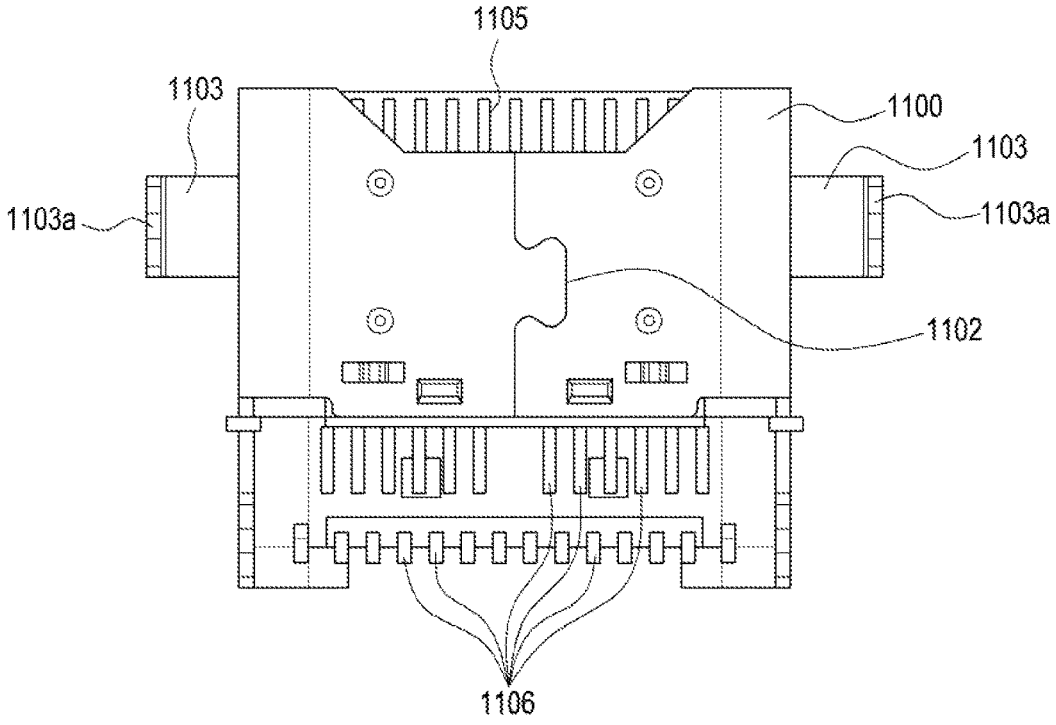
FIG. 8 is a view illustrating a rear face of a connector main body, among components of a connector device according to various embodiments of the present disclosure.

FIG. 8 is a view illustrating a rear face of a connector main body, among components of a connector device according to various embodiments of the present disclosure.

Referring to FIG. 8, when the main body-side coupling portions 1103 are formed in and simultaneously bent from the connector main body 1100 manufactured by the pressing method, the holes 1101 are formed in the connector main body 1100, and the first housing 1200 may cover and shield the first holes 1101. The slot 1102 formed in the bottom face of the connector main body 1100 may be shielded by coupling the second housing 1300.

Figure 9:
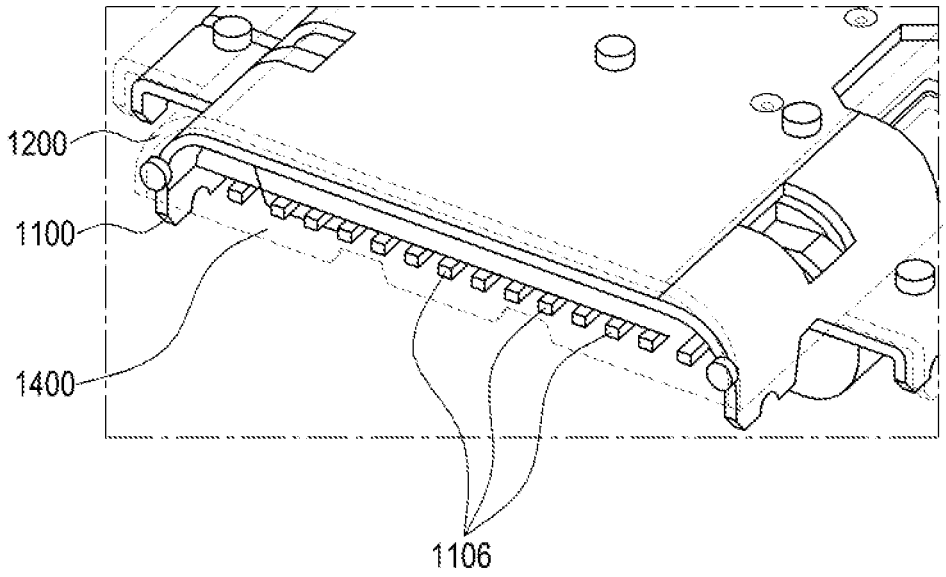
FIG. 9 is a perspective view illustrating connection terminals of a connector main body, among components of a connector device according to various embodiments of the present disclosure.

FIG. 9 is a perspective view illustrating connection terminals of a connector main body, among components of a connector device according to various embodiments of the present disclosure.

Referring to FIG. 9, when the first and second housings 1200 and 1300 are respectively coupled to the top and bottom faces of the connector main body 1100, the first and second shielding members 1400 and 1500, which are respectively included in the rear faces of the first and second housings 1200 and 1300, may cover and shield the rear face of the connector main body 1100. One or more connection terminals 1106 may be provided on the rear face of the connector main body 1100, so that, at the time at which the connector main body 1100 is coupled to the top face of the board 101*b*, the connection terminals 1106 may face the top face of the board 101*b* and may be electrically connected to a connection terminal (not illustrated) provided on the board 101*b*.

For example, referring to FIG. 5, when the first housing 1200 is coupled to the top face of the connector main body 1100, the rear faces of the one or more first housing-side first coupling portions 1601 may face the front faces of the second housing-side first coupling portions 1701, and the rear faces of the one or more first housing-side second coupling portions 1602 may face the top faces of the main body-side coupling portions 1103 of the connector main body 1100. The main body-side coupling portions 1103 of the connector main body 1100 may be coupled to the second housing-side second coupling portions 1702.

Since the second housing-side second coupling portions 1702 may include coupling holes 1101, the main body-side coupling portions 1103 of the connector main body 1100 may be inserted into and coupled to the coupling holes 1101.

At least a portion of the first housing-side second coupling portions 1602 may be coupled with the second housing-side third coupling portions 1703.

Ends of the first housing-side first coupling portions 1601 may include first fixing portions 1810 coupled to the fixing portions 1701*a* included in the second housing-side first coupling portions 1701, and ends of the first housing-side second coupling portions 1602 may include second fixing portions 1820 seated on and covering the main body-side fixing portions 1103*a* included in the main body-side coupling portions 1103 of the connector main body 1100.

Figure 10:
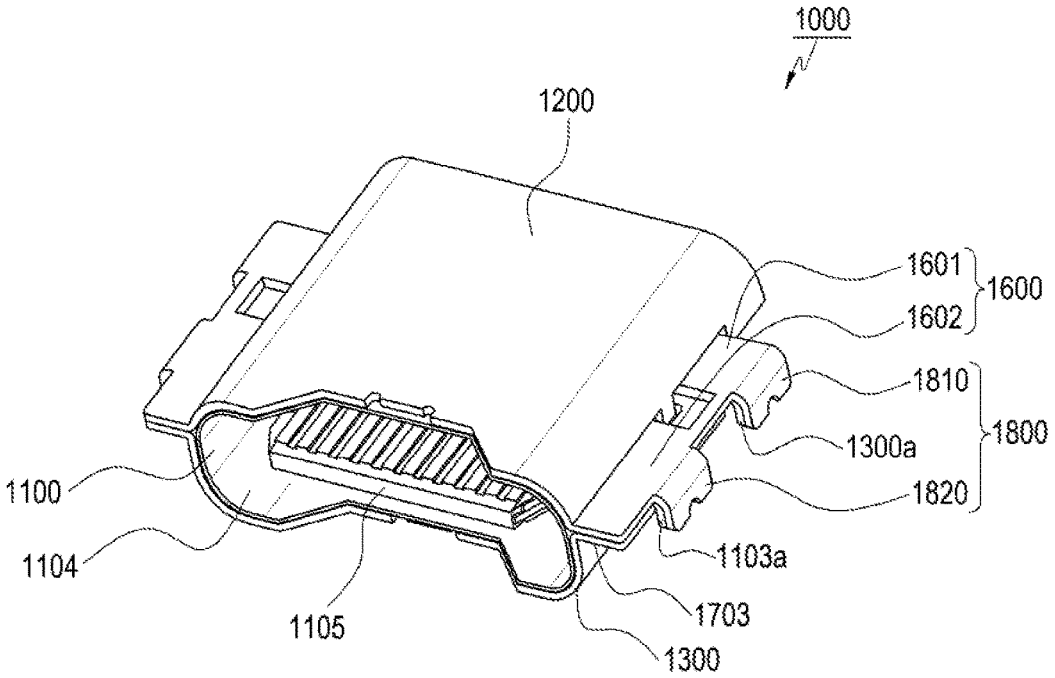
FIG. 10 is a perspective view illustrating a coupled state of a connector device according to various embodiments of the present disclosure.

FIG. 10 is a perspective view illustrating a coupled state of a connector device according to various embodiments of the present disclosure.

Referring to FIG. 10, the first and second housings 1200 and 1300 may be coupled to the connector main body 1100, and the first and second housings 1200 and 1300 and the connector main body 1100 may be fixed to each other by one or more welds. The first housing-side first coupling portions 1601 and the second housing-side first coupling portions 1701 may be fixed to each other by welding, and the first housing-side second coupling portions 1602 and the second housing-side third coupling portion 1703 may be fixed to each other by welding.

For example, when the first and second housings 1200 and 1300 are coupled to cover the top and bottom faces of the connector main body 1100, the first housing-side first coupling portions 1601 may face the second housing-side first coupling portions 1701, thereby being coupled to the second housing-side first coupling portions 1701. At this time, the first fixing portions 1810 formed on ends of the first housing-side first coupling portions 1601 may face the fixing portions 1300*a* formed on the second housing-side first coupling portions 1701, thereby being coupled to the fixing portions 1300*a* formed on the second housing-side first coupling portions 1701.

The first housing-side second coupling portions 1602 may face the main body-side coupling portions 1103, thereby being coupled to the main body coupling portion 1103, and the second fixing portions 1820 formed at ends of the first housing-side second coupling portions 1602 may be seated on and coupled to the main body-side fixing portions 1103*a* formed on ends of the main body-side coupling portions 1103 while covering the main body-side fixing portions 1103*a*.

Figure 11:
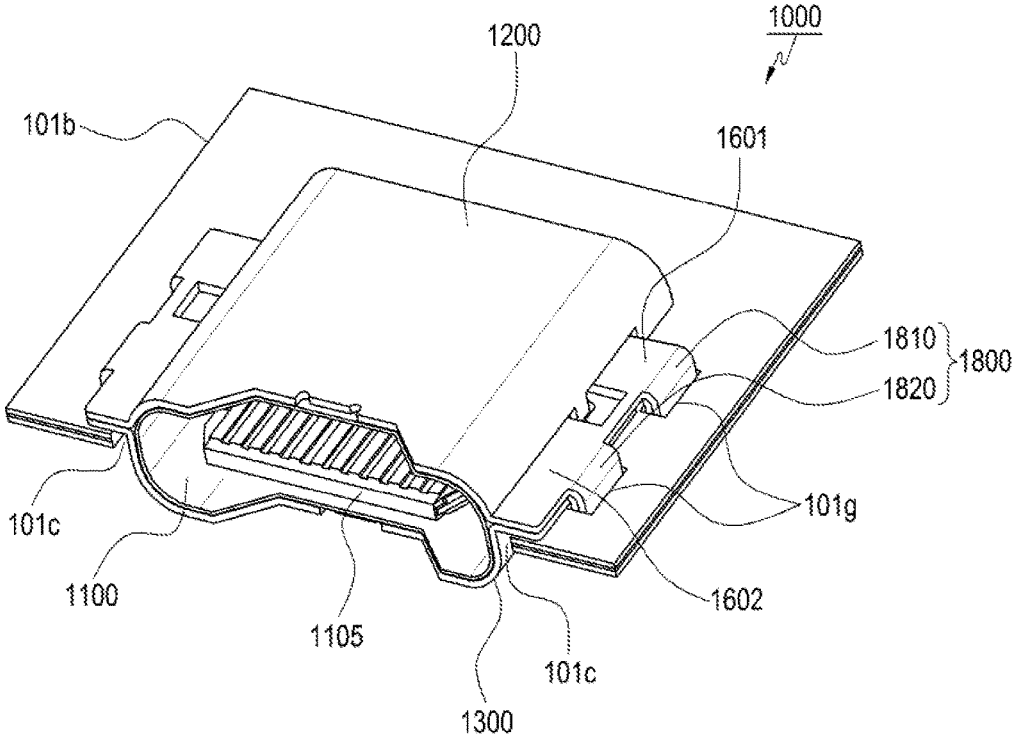
FIG. 11 is a perspective view illustrating a state in which a connector device according to various embodiments of the present disclosure is coupled to a board of an electronic device.

FIG. 11 is a perspective view illustrating a state in which a connector device is coupled to a board of an electronic device according to various embodiments of the present disclosure.

Referring to FIG. 11, the connector device 1000 assembled as described above may be coupled to the board 101*b*. For example, the second housing 1300 of the connector device 1000 may be seated in a seating hole 101*c* included in the board 101*b*, and at the same time, one or more fixing portions 1800 included in the connector device 1000 may be respectively coupled to one or more fixing holes 1101 formed in the board 101*b*. The fixing portions 1800 may be coupled and simultaneously welded to the fixing holes 101*g* in the board 101*b* so as to fix the connector device 1000 to the board 101*b*.

Figure 12:
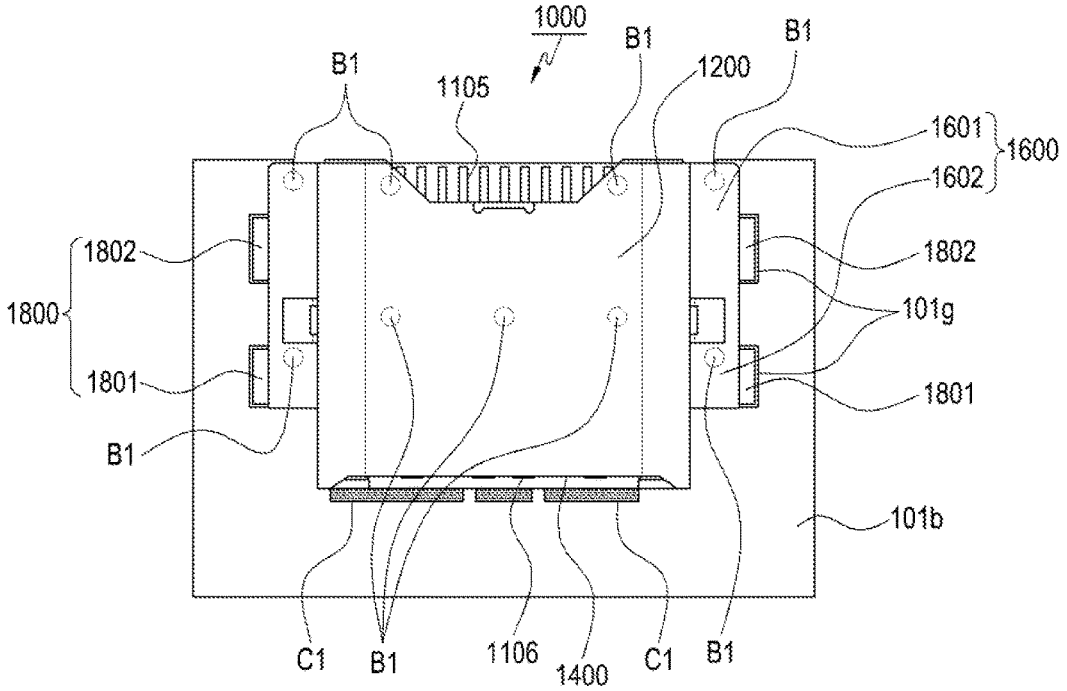
FIG. 12 is a top plan view illustrating a state in which a connector device according to various embodiments of the present disclosure is coupled to a board of an electronic device.

FIG. 12 is a top plan view illustrating a state in which a connector device is coupled to a board of an electronic device according to various embodiments of the present disclosure.

Figure 13:
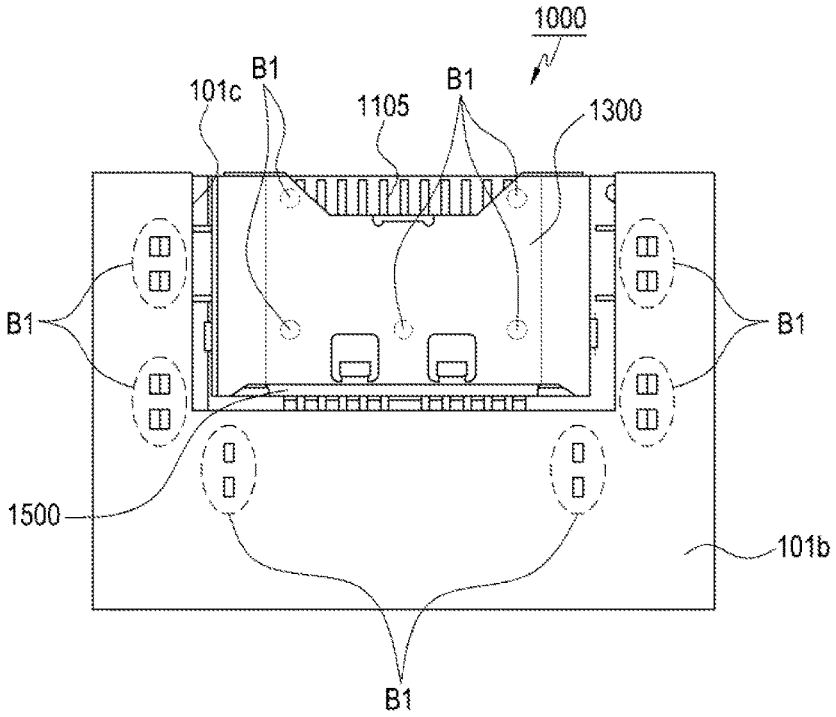
FIG. 13 is a bottom view illustrating a state in which a connector device according to various embodiments of the present disclosure is coupled to a board of an electronic device.

FIG. 13 is a bottom view illustrating a state in which a connector device is coupled to a board of an electronic device according to various embodiments of the present disclosure.

Referring to FIGS. 12 and 13, the first housing 1200 may be coupled to the top face of the connector main body 1100, and may be fixed in this state by one or more welds B1. In addition, the second housing 1300 may be fixed to the bottom face of the connector main body 1100 by one or more welds B1. First fixing portions 1810 included in ends of the first housing-side first coupling portions 1601 and fixing portions 1800 formed on ends of the second housing-side first coupling portions 1701 may be coupled to the fixing holes 101*g* in the board, and the second fixing portions 1820 included in the ends of the first housing-side second coupling portions 1602 and the main body-side fixing portions 1103*a* included in the main body-side coupling portions 1103 of the connector main body 1100 may be coupled to the fixing holes 101*g* in the board. The first and second fixing portions 1800 coupled as described above may be fixed to the board 101*b* by one or more welds B1. The first and second fixing portions 1800 coupled as described above may be fixed to the board 101*b* by one or more welds B1. The connector device 1000 may be fixed to the board 101*b* by a method other than welding. For example, the connector device 1000 may be fixed to the board 101*b* using adhesive and silicon.

As described above with reference to FIG. 12, the first shielding member 1400 may be coupled to a pad on the board 101*b* included in the electronic device 101 so as to remove a gap formed between the first shielding member 1400 and the board 101*b*. Through this, the noise generated from terminals 1106 can be blocked. For example, the removal of the gap may be achieved by at least one solder C1 or by a weld.

Figure 14:
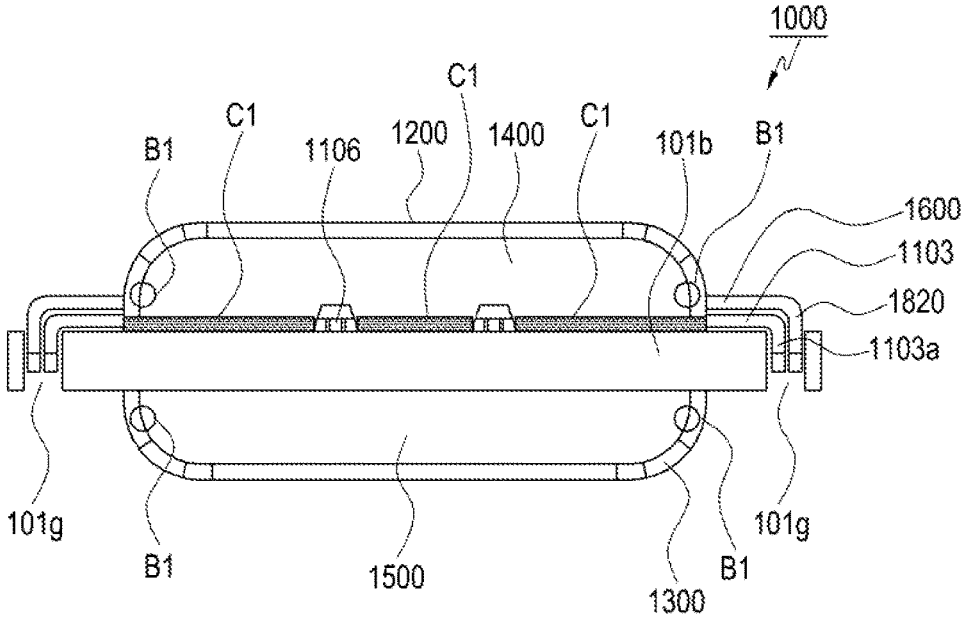
FIG. 14 is a view illustrating a state in which a connector device according to various embodiments of the present disclosure is coupled to a board of an electronic device.

FIG. 14 is a view illustrating a state in which a connector device is coupled to a board of an electronic device according to various embodiments of the present disclosure.

Referring to FIG. 14, the first shielding member 1400 provided on the rear face of the first housing may be manufactured through a pressing method of the first housing 1200. At this time, the first shielding member 1400 is provided on the rear face of the first housing 1200 in a spread state, and the first shielding member 1400 in the spread state may be bent so as to shield the rear face of the first housing 1200. In this state, the first shielding member 1400 may be fixed to the rear face of the first housing 1200 by at least one weld B1. Similarly, the second shielding member 1500 provided on the rear face of the second housing may be manufactured by a pressing method, and the second shielding member 1500 may be provided on the rear face of the second housing 1300 in the spread state. At this time, the second shielding member 1500 may be bent so as to shield the rear face of the second housing 1300. In this state, the second shielding member 1500 may be fixed to the rear face of the second housing 1300 by at least one weld B1.

As described above with reference to FIG. 14, the first shielding member 1400 may be coupled to a pad on the board 101*b* included in the electronic device 101 so as to remove a gap formed between the first shielding member 1400 and the board 101*b*. Through this, the noise generated from the terminals 1106 can be blocked. For example, the removal of the gap may be achieved by at least one solder C1 or by a weld.

Figure 15:
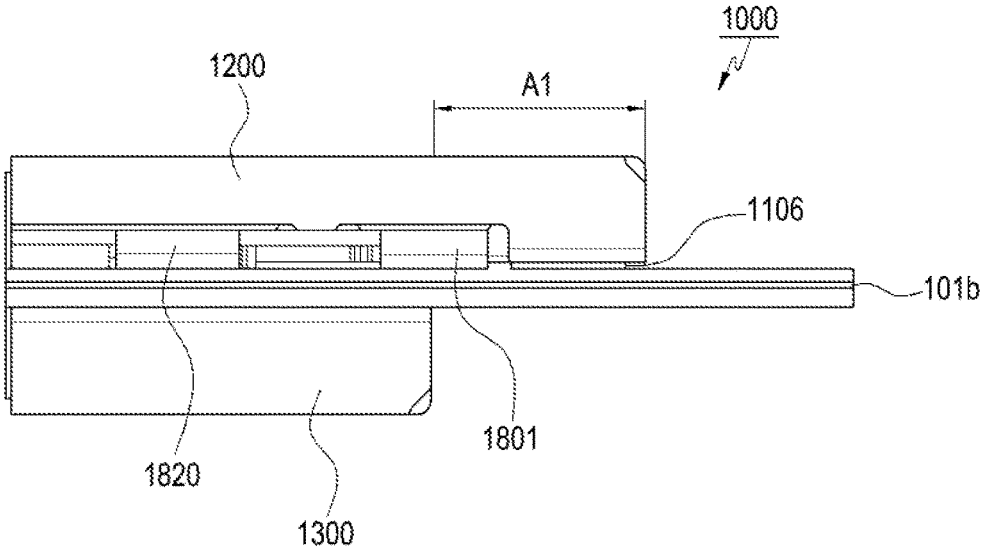
FIG. 15 is a side view illustrating a state in which a connector device according to various embodiments of the present disclosure is coupled to a board of an electronic device.

FIG. 15 is a side view illustrating a state in which a connector device is coupled to a board of an electronic device according to various embodiments of the present disclosure.

Referring to FIG. 15, the first housing 1200 may be formed to be longer than the second housing 1300. For example, a connector main body 1100 may be embedded in the first housing 1200, and one or more connection terminals 1106 may be provided in the connector main body 1100 such that the one or more connection terminals 1106 can be electrically connected to connection terminals (not illustrated) included in the board 101*b*. In order to enable the one or more connection terminals 1106 to be electrically connected to the connection terminals (not illustrated) on the board 101*b*, the first housing 1200 may be formed to be longer than the second housing 1300, and the extension portion A1 of the first housing 1200 is provided with the one or more connection terminals 1106 of the connector main body 1100. Thus, when the second housing 1300 is seated in and coupled to the seating hole 101*c* in the board, the extension portion A1 of the first housing 1200 faces the top face of the board 101*b*. At this time, the one or more connection terminals 1106 of the connector main body 1100 may be electrically connected to one or more connection terminals (not illustrated) on the board 101*b*. For example, when the second housing 1300 is coupled to the seating hole 101*c*, the extension portion of the first housing 1200 may face the top face of the board 101*b*, and at the same time, the one or more connection terminals 1106 provided in the connector main body 1100 may be coupled to the upper surface of the board 101*b*. Simultaneously therewith, the one or more connection terminals 1106 may face the connection terminals (not illustrated) on the board 101*b*, thereby being electrically connected to the connection terminals on the board.

In this state, an external plug connector may be inserted into and electrically coupled to the connector device, and the connector device may be electrically connected to an external charger (not illustrated) such that the connector body may be used not only for supplying power to the battery pack included in the electronic device so as to charge the battery pack, but also for inputting/outputting various data. At this time, noise generated in the connector device may be blocked by the first and second housings 1200 and 1300 and the first and second shielding members 1400 and 1500, and as a result, deterioration of antenna radiation performance can be prevented.

According to various embodiments of the present disclosure, a connector device included in an electronic device may include a connector main body including at least one hole and a slot, at least one housing coupled to the connector main body to shield the at least one hole and the slot formed in the connector main body, a shielding member included in a rear face of the at least one housing, at least one coupling portion included in each of opposite side faces of the at least one housing so as to couple the at least one housing, and at least one fixing portion included in one end of the at least one coupling portion and fixed to a board included in the electronic device.

According to various embodiments of the present disclosure, the at least one housing may include a first housing coupled to a top face of the connector main body to enclose the top face of the connector main body, the first housing shielding the at least one hole and the slot formed in the top face of the connector main body, and a second housing coupled to the bottom face of the connector main body to enclose the bottom face of the connector main body, the second housing shielding the at least one hole and the slot formed in the bottom face of the connector main body.

According to various embodiments of the present disclosure, a connector device included in an electronic device may include a connector main body including at least one hole and a slot, a first housing coupled to a top face of the connector main body to enclose the top face of the connector main body, the first housing shielding the at least one hole and the slot formed in the top face of the connector body, a second housing coupled to the bottom face of the connector main body to enclose a bottom face of the connector main body, the second housing shielding the at least one hole and the slot formed in the bottom face of the connector main body, first and second shielding members included in rear faces of the first and second housings and shielding the rear faces of the first and second housings, at least one coupling portion included in each of opposite side faces of the first and second housings to couple the first and second housings, and at least one fixing portion included in one end of the at least one coupling portion and fixed to a board included in the electronic device.

According to various embodiments of the present disclosure, the at least one coupling portion may be coupled by welding so as to couple the first and second housings.

According to various embodiments of the present disclosure, the first and second shielding members may be bent from a spread state to face the rear faces of the first and second housings and may be fixed to the rear faces of the first and second housings by welding.

According to various embodiments of the present disclosure, the at least one coupling portion may include at least one first housing-side first coupling portion included in the first housing and coupled with a second housing-side first coupling portion included in the second housing, and at least one first housing-side second coupling portion included adjacent to the at least one second housing-side first coupling portion and coupled with a main body-side coupling portion included in each of opposite side faces of the connector main body.

According to various embodiments of the present disclosure, the at least one coupling portion may include at least one second housing-side first coupling portion included in the second housing and coupled with the first housing-side first coupling portion, at least one second housing-side second coupling portion included adjacent to the second housing-side first coupling portion and coupled with a main body-side coupling portion included in each of opposite side faces of the connector main body, and at least one second housing-side third coupling portion included adjacent to the second housing-side second coupling portion and coupled with at least a portion of the first housing-side second coupling portion.

According to various embodiments of the present disclosure, the at least one second housing-side second coupling portion may include a coupling hole.

According to various embodiments of the present disclosure, the fixing portion may include a first fixing portion included in one end of the first housing-side first coupling portion and coupled to the fixing portion included in the second housing-side first coupling portion, and a second fixing portion included in one end of the first housing-side second coupling portion and seated on and covering the main body-side fixing portion included in the main body-side coupling portion of the connector main body.

According to various embodiments of the present disclosure, the at least one fixing portion may couple the connector main body within the first and second housings and the first and second housings may be welded so as to fix the first and second housings to the board.

According to various embodiments of the present disclosure, the board may include a seating hole configured to seat the second housing therein.

According to various embodiments of the present disclosure, the first housing may be formed to have a length longer than that of the second housing.

Another embodiment of one or more fixing portions 1900, which are included in the connector device 1000 according to an embodiment, will be described below.

Figure 16A:
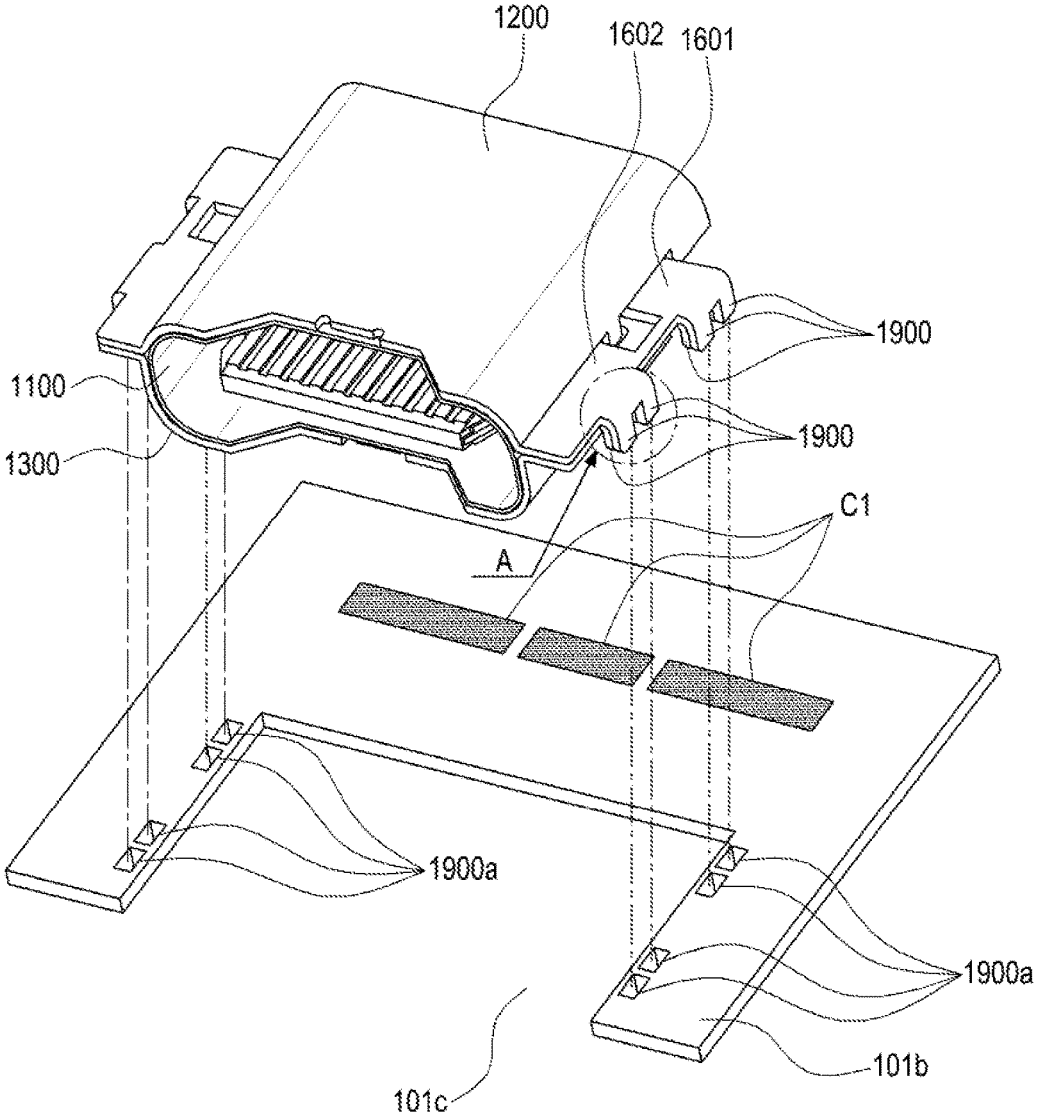
FIG. 16A is a perspective view illustrating another embodiment of fixing portions, among components of a connector device according to various embodiments of the present disclosure.

FIG. 16A is a perspective view illustrating another embodiment of fixing portions, among components of a connector device according to various embodiments of the present disclosure.

Figure 16B:
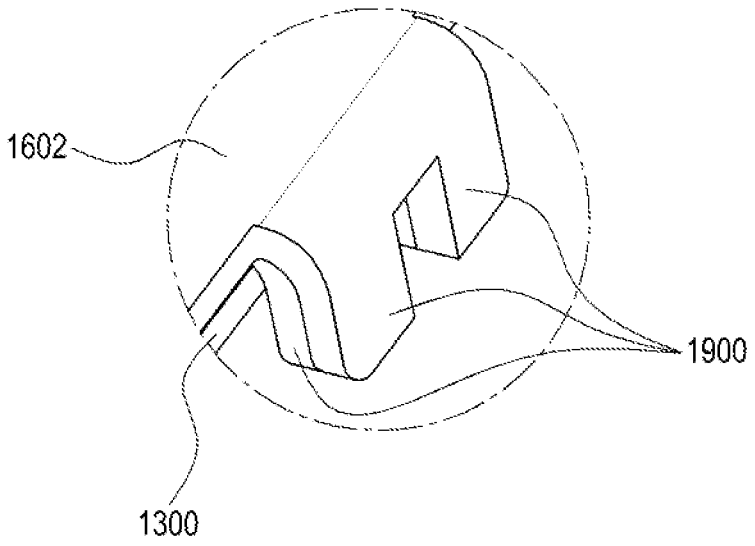
FIG. 16B is an enlarged perspective view of portion "A" in FIG. 16A according to various embodiments of the present disclosure.

FIG. 16B is an enlarged perspective view of portion "A" in FIG. 16A according to various embodiments of the present disclosure.

Referring to FIGS. 16A and 16B, the one or more fixing portions 1900 may include one or more fixing protrusions 1900 configured to be fixedly coupled to one or more board holes 1900*a* formed in the board 101*b*.

For example, the one or more fixing protrusions 1900 may be formed at ends of the first housing-side first and second coupling portions 1601 and 1602, and may be formed at ends of the second housing-side first coupling portions 1701. The one or more fixing protrusions 1900 may be formed in the main body-side coupling portions 1103 of the connector main body 1100.

The one or more fixing protrusions 1900 may be coupled to the one or more board holes 1900*a* formed in the board 101*b*. The fixing protrusions 1900 coupled as described above may be fixed to the board 101*b* by being welded together with the board holes 1900*a*.

As described above, by configuring one or more fixing protrusions 1900 on one or more coupling portions to be fixedly coupled to the board holes 1900*a* of the board 101*b*, it is possible to further improve the fixing force of a product fixed to the board 101*b*. Therefore, it is possible to prevent the product from being damaged due to an external impact or fall.

As described above with reference to FIG. 16A, the first shielding member 1400 (see FIG. 14) provided on the rear face of the first housing may be manufactured through a pressing method of the first housing 1200. At this time, the first shielding member 1400 (see FIG. 14) is provided on the rear face of the first housing 1200 in a spread state, and the first shielding member 1400 (see FIG. 14) in the spread state may be bent so as to shield the rear face of the first housing 1200. In this state, the first shielding member 1400 (see FIG. 14) may be fixed to the rear face of the first housing 1200 by at least one weld B1.

In this way, the first shielding member 1400 (see FIG. 14) is coupled to a pad on the board 101*b* included in the electronic device 101, so that a gap formed between the first shielding member 1400 (see FIG. 14) and the board 101*b* can be eliminated. Through this, the noise generated from the terminals 1106 (see FIG. 14) can be blocked. For example, the removal of the gap may be achieved by at least one solder C1 or by a weld.

According to various embodiments of the present disclosure, the at least one fixing portion may include at least one fixing protrusion fixedly coupled to at least one board hole formed in the board.

Figure 17:
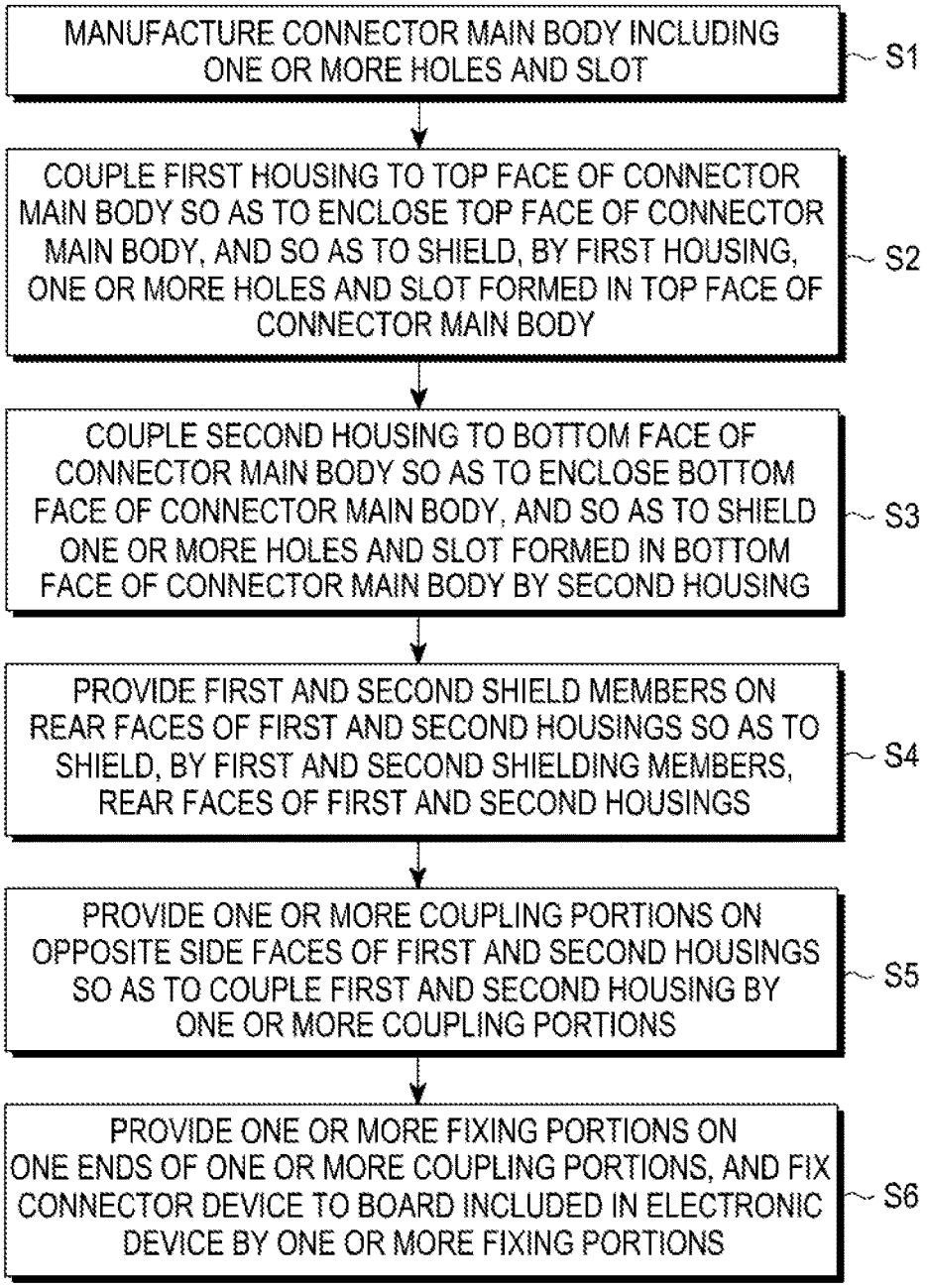
FIG. 17 is a flowchart illustrating a method of manufacturing a connector device according to various embodiments of the present disclosure.

FIG. 17 is a flowchart illustrating a method of manufacturing a connector device according to various embodiments of the present disclosure.

Referring to FIG. 17, a method of manufacturing a connector device will be described. A connector main body 1100 may be manufactured by a pressing method of a metallic SUS plate, and the front face of the connector main body 1100 manufactured in this way may include an opening 1104, and at least one hole 1101 and a slot 1102 may be formed on the upper, lower, and rear faces of the connector main body 1100 at operation S1.

The first housing 1200 may be coupled to the top face of the connector main body 1100 while enclosing the top face of the connector main body 1100, and the first housing 1200 may enclose and shield the at least one hole 1101 and the slot 1102 included in the top face of the connector main body 1100 at operation S2.

For example, the first housing 1200 may cover and shield at least one hole 1101 included in the top face of the connector main body 1100.

The second housing 1300 may be coupled to the bottom face of the connector main body 1100 while enclosing the bottom face of the connector main body 1100, and the second housing 1300 may shield the at least one hole 1101 and the slot 1102 formed in the bottom face of the connector main body 1100 at operation S3.

For example, the second housing may cover and shield the at least one slot 1102 included in the bottom face of the connector main body 1100.

A first shielding member 1400 may be provided on the rear face of the first housing 1200 and may be bent so as to shield the rear face of the first housing 1200, and a second shielding member 1500 may be provided on the rear face of the second housing 1300 and may be bent so as to shield the rear face of the second housing 1300 at operation S4.

Each of the first and second housings 1200 and 1300 may include one or more coupling portions 1600 or 1700 on each of the opposite side faces, and the one or more coupling portions 1600 or 1700 may allow the first and second housings 1200 and 1300 to be coupled thereto at operation S5.

The one or more coupling portions 1600 or 1700 may include one or more first housing-side first and second coupling portions 1601 and 1602 included in the first housing 1200, and one or more second housing-side first, second, and third coupling portions 1701, 1702, and 1703 included in the second housing 1300.

In this state, when the first and second housings 1200 and 1300 are coupled to the top and bottom faces of the connector main body 1100, the first housing-side first coupling portions 1601 and the second housing-side first coupling portions 1701 may be coupled so as to face each other.

The first housing-side second coupling portions 1602 may face and be coupled to the main body-side coupling portions 1103 of the connector main body 1100 while the main body-side coupling portions 1103 may penetrate and may be coupled to the second housing-side second coupling portions 1702. For example, since the second housing-side second coupling portions 1702 may include coupling holes 1101 formed therein, the main body-side coupling portions 1103 of the connector main body 1100 may penetrate and may be coupled to the coupling holes 1101.

At least a portion of the first housing-side second coupling portions 1602 may face and be coupled with the second housing-side third coupling portions 1703.

The first and second housings 1200 and 1300 coupled as described above may be fixedly coupled to the connector main body 1100 and the coupling portions 1600 and 1700 by welding.

The one or more fixing portions 1800 may include one or more fixing portions 1800 at ends of the one or more coupling portions 1600 or 1700, and the one or more fixing portions 1800 may be fixed to the board 101*b* included in the electronic device 101 (see FIG. 4) at operation S6.

The one or more fixing portions 1800 may be fixedly coupled to one or more fixing holes 101*g* included in the board 101*b*, and the one or more fixing portions 1800 coupled to the one or more fixing holes 101*g* may be fixed to the board 101*b* by welding.

According to various embodiments of the present disclosure, a method of manufacturing a connector device may include manufacturing a connector main body by a pressing method such that the connector main body manufactured in this way includes at least one hole and a slot, coupling a first housing to a top face of the connector main body to enclose the top face of the connector main body so as to shield the at least one hole and the slot formed in the top face of the connector body are shielded by the first housing, coupling the second housing to a bottom face of the connector main body to enclose the bottom face of the connector main body so as to shield the at least one hole and the slot formed in the bottom face of the connector by the second housing, providing first and second shielding members on the rear faces of the first and second housings so as to shield the rear faces of the first and second housings by the first and second shielding members; providing at least one coupling portion on each of opposite side faces of the first and second housings so as to couple the first and second housings by the at least one coupling portion, and providing at least one fixing portion at one end of the at least one coupling portion so as to fix the connector device to a board included in the electronic device by the at least one fixing portion.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A connector device used in an electronic device, the connector device comprising:

a connector main body including at least one hole or a slot;

first and second housings coupled to the connector main body for shielding the at least one hole or the slot;

first and second shielding members included in a rear face of the first and second housings;

first and second coupling portions included in each of opposite side faces of the first housing;

first and second coupling portions included in each of opposite side faces of the second housing and coupled with the first and second coupling portion of the first housing for coupling the first and second housings to a board included in the electronic device; and at least one fixing portion included in one end of the first and second coupling portions of the first housing and one end of the first and second coupling portions of the second housing and fixed to the board included in the electronic device.

2. The connector device of claim 1, wherein the first and second housings include:

the first housing coupled to a top face of the connector main body to enclose the top face of the connector main body, the first housing shielding the at least one hole or the slot formed in the top face of the connector main body; and the second housing coupled to a bottom face of the connector main body to enclose the bottom face of the connector main body, the second housing shielding the at least one hole or the slot formed in the bottom face of the connector main body.

3. A connector device used in an electronic device, the connector device comprising:

a connector main body including at least one hole or a slot;

a first housing coupled to a top face of the connector main body to enclose the top face of the connector main body, the first housing shielding the at least one hole or the slot;

a second housing coupled to the bottom face of the connector main body to enclose a bottom face of the connector main body, the second housing shielding the at least one hole or the slot formed in the bottom face of the connector main body;

first and second shielding members included in rear faces of the first and second housings and shielding the rear faces of the first and second housings;

first and second coupling portions included in each of opposite side faces of the first housing;

first and second coupling portions included in each of opposite side faces of the second housing and coupled with the first and second coupling portion of the first housing for coupling the first and second housings to a board included in the electronic device; and at least one fixing portion included in one end of the first and second coupling portions of the first housing and one end of the first and second coupling portions of the second housing and fixed to a board included in the electronic device.

4. The connector device of claim 3, wherein the first and second coupling portions are welded so as to couple the first and second housings.

5. The connector device of claim 3, wherein the first and second shielding members are bent from a spread state to face the rear faces of the first and second housings and fixed to the rear faces of the first and second housings by welding.

6. The connector device of claim 3, further comprising:

a main body-side coupling portion included in each of opposite side faces of the connector main body, wherein the first and second coupling portions of the first housing includes:

the first coupling portion included in the first housing and coupled with the first coupling portion of the second housing, and the second coupling portion included adjacent to the first coupling portion of the first housing and coupled with the main body-side coupling portion.

7. The connector device of claim 6, wherein the first and second coupling portions of the second housing further include:

the first coupling portion included in the second housing and coupled with the first coupling portion of the first housing;

the second coupling portion included adjacent to the first coupling portion of the second housing and coupled with the main body-side coupling portion; and a third coupling portion included adjacent to the second coupling portion of the second housing and coupled with a portion of the second coupling portion of the first housing.

8. The connector device of claim 7, wherein the second coupling portion, included in the second housing, includes a coupling hole formed therein.

9. The connector device of claim 8, wherein the at least one fixing portion includes:

a first fixing portion included in one end of the first coupling portion included in the first housing and coupled to a fixing portion included in the first coupling portion included in the second housing; and a second fixing portion, included in one end of the second coupling portion included in the first housing, seated on and covering the main body-side fixing portion included in the main body-side coupling portion of the connector main body.

10. The connector device of claim 3, wherein the at least one fixing portion couples the connector main body within the first and second housings and the first and second housings are welded so as to fix the first and second housings to the board.

11. The connector device of claim 10, wherein the board includes a seating hole configured to seat the second housing therein.

12. The connector device of claim 3, wherein the first housing is formed to have a length longer than a length of the second housing.

13. The connector device of claim 3, wherein the at least one fixing portion includes at least one fixing protrusion fixedly coupled to at least one board hole formed in the board.

14. A method of manufacturing a connector device, the method comprising:

manufacturing a connector main body by a pressing method such that the connector main body includes at least one hole or a slot;

coupling a first housing to a top face of the connector main body to enclose the top face of the connector main body such that the at least one hole or the slot is shielded by the first housing;

coupling the second housing to a bottom face of the connector main body to enclose the bottom face of the connector main body so as to shield the at least one hole or the slot by the second housing;

providing first and second shielding members on the rear faces of the first and second housings so as to shield the rear faces of the first and second housings by the first and second shielding members;

providing at least one coupling portion on each of opposite side faces of the first and second housings so as to couple the first and second housings by the at least one coupling portion; and providing at least one fixing portion at one end of the at least one coupling portion so as to fix the connector device to a board included in the electronic device by the at least one fixing portion.

* * * * *